US008388386B2

(12) United States Patent
Petersen

(10) Patent No.: US 8,388,386 B2
(45) Date of Patent: Mar. 5, 2013

(54) PLUG CONTACT ARRANGEMENT AND THE MANUFACTURE THEREOF

(75) Inventor: Cycle D. Petersen, Belle Plaine, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 13/273,682

(22) Filed: Oct. 14, 2011

(65) Prior Publication Data

US 2012/0208401 A1 Aug. 16, 2012

Related U.S. Application Data

(60) Provisional application No. 61/405,902, filed on Oct. 22, 2010.

(51) Int. Cl.
*H01R 24/00* (2011.01)

(52) U.S. Cl. ..... 439/676; 439/620.22

(58) Field of Classification Search ..... 439/676, 439/941, 620.11, 620.17, 620.23, 501, 528, 439/620.22

See application file for complete search history.

(56) References Cited

U.S. PATENT DOCUMENTS

| | | | | |
|---|---|---|---|---|
| 5,052,940 | A | 10/1991 | Bengal | |
| 5,197,895 | A * | 3/1993 | Stupecky | 439/194 |
| 5,382,182 | A * | 1/1995 | Shen et al. | 439/676 |
| 5,415,570 | A * | 5/1995 | Sarkissian | 439/676 |
| 5,660,567 | A * | 8/1997 | Nierlich et al. | 439/620.21 |
| 6,244,908 | B1 * | 6/2001 | Hammond et al. | 439/676 |
| 6,431,892 | B1 * | 8/2002 | Shupe et al. | 439/188 |
| 6,641,443 | B1 * | 11/2003 | Itano et al. | 439/676 |
| 6,663,436 | B1 * | 12/2003 | Arnett et al. | 439/676 |
| 6,786,776 | B2 * | 9/2004 | Itano et al. | 439/676 |
| 6,793,408 | B2 | 9/2004 | Levy et al. | |
| 7,314,392 | B2 * | 1/2008 | Pharn et al. | 439/676 |
| 7,314,393 | B2 * | 1/2008 | Hashim | 439/676 |
| 7,914,310 | B2 * | 3/2011 | Johansson et al. | 439/284 |
| 2003/0100229 | A1 | 5/2003 | Ma et al. | |
| 2011/0092100 | A1 | 4/2011 | Coffey et al. | |

FOREIGN PATENT DOCUMENTS

| | | | |
|---|---|---|---|
| DE | 41 14 921 | A1 | 11/1992 |
| WO | WO 2008/109082 | A1 | 9/2008 |

OTHER PUBLICATIONS

International Search Report and Witten Opinion mailed Jan. 16, 2012.

Adams, T. "Chip-scale Packages: Inspection Methods for Diverse Designs," Electronics Engineer, Nov. 1997; 3 pages.

Design and Manufacturing with Summit Microelectronics WLCSP Products, Summit Microelectronics, Apr. 2, 2010; 8 pages.

IK-16K UNIO Serial EEPROM Family Data Sheet, Microchip, Inc.; Jan. 5, 2010; 44 pages.

NF-260 No Flow Underfill for Pb-Free, Indium Corporation, 2008; 2 pages.

Semmens, J. "An Overview of Solder Bond Evaluations in Electronics Applications Using Acoustic Micro Imaging (AMI)," Sonoscan, Elk Grove, IL 2001; 6 pages.

* cited by examiner

*Primary Examiner* — Neil Abrams
*Assistant Examiner* — Phuongchi Nguyen
(74) *Attorney, Agent, or Firm* — Merchant & Gould P.C.

(57) ABSTRACT

A plug can include a set of primary contacts for communication signal transmission, a storage device to store physical layer information (PLI), and a set of secondary contacts for PLI signal transmission. One or more sets of secondary contacts may be manufactured from a conductive strip. The storage device associated with each set may be mounted to an insulating layer that physically connects the contacts of each set.

6 Claims, 20 Drawing Sheets

PLUG CONTACT ARRANGEMENT AND THE MANUFACTURE THEREOF

CROSS REFERENCE TO RELATED APPLICATIONS

This application claims the benefit of U.S. Provisional Application No. 61/405,902, filed Oct. 22, 2010, and titled "Plug Contact Arrangement and the Manufacture Thereof," the disclosure of which is hereby incorporated herein by reference.

BACKGROUND

In communications infrastructure installations, a variety of communications devices can be used for switching, cross-connecting, and interconnecting communications signal transmission paths in a communications network. Some such communications devices are installed in one or more equipment racks to permit organized, high-density installations to be achieved in limited space available for equipment.

Communications devices can be organized into communications networks, which typically include numerous logical communication links between various items of equipment. Often a single logical communication link is implemented using several pieces of physical communication media. For example, a logical communication link between a computer and an inter-networking device such as a hub or router can be implemented as follows. A first cable connects the computer to a jack mounted in a wall. A second cable connects the wall-mounted jack to a port of a patch panel, and a third cable connects the inter-networking device to another port of a patch panel. A "patch cord" cross connects the two together. In other words, a single logical communication link is often implemented using several segments of physical communication media.

Network management systems (NMS) are typically aware of logical communication links that exist in a communications network, but typically do not have information about the specific physical layer media (e.g., the communications devices, cables, couplers, etc.) that are used to implement the logical communication links. Indeed, NMS systems typically do not have the ability to display or otherwise provide information about how logical communication links are implemented at the physical layer level.

SUMMARY

The present disclosure relates to communications connector assemblies and arrangements that provide physical layer management (PLM) capabilities. In accordance with certain aspects, the disclosure relates to a contact arrangement that can be used in connector assemblies and/or connector arrangements and processes for the manufacture thereof.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
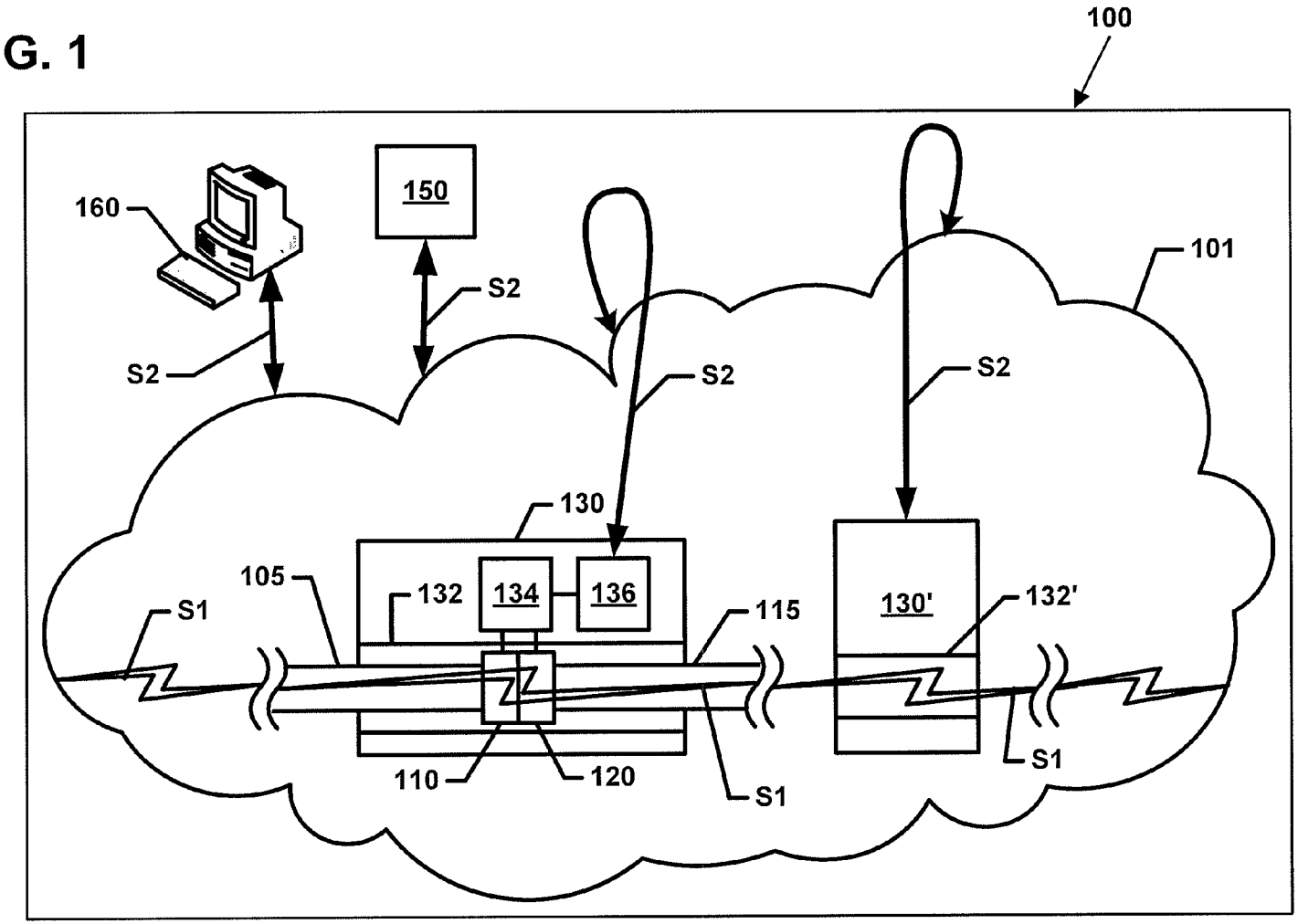
FIG. 1 is a block diagram of a portion of an example communications and data management system in accordance with aspects of the present disclosure.

FIG. 1 is a block diagram of a portion of an example communications and data management system 100. The portion of the example system 100 shown in FIG. 1 includes a primary connector assembly 130 at which primary signals (e.g., communication signals) S1 can pass from one portion of a communications network 101 to another portion of the communications network 101. For example, the primary signals S1 can pass from a first network splitter to a second network splitter; from a first communications panel to a second communications panel, from a wall outlet to a computer, etc.

In the example shown, the first connector assembly 130 defines at least one port 132 configured to communicatively couple at least a first media segment 105 to at least a second media segment 115 to enable the primary signals S1 to pass between the media segments 105, 115. Non-limiting examples of media segments include optical fibers, which carry optical data signals, and electrical conductors (e.g., CAT-5, 6and 7 twisted-pair cables, DS1 line, DS3 line), which carry electrical data signals. Media segments also can include electrical plugs, fiber optic connectors (e.g., SC, LC, FC, LX.5, or MPO connectors), adapters, media converters, and other physical components terminating to the fibers, conductors, or other such media segments. The techniques described here also can be used with other types of connectors including, for example, BNC connectors, F connectors, RJ jacks, DSX jacks and plugs, bantam jacks and plugs.

In the example shown, each media segment 105, 115 is terminated at a plug or connector 110, 120, respectively, which are configured to communicatively connect the media segments 105, 115. For example, in one implementation, the port 132 of the connector assembly 130 can be configured to align ferrules of two fiber optic connectors 110, 120. In another implementation, the port 132 of the connector assembly 130 can be configured to connect an electrical plug with an electrical socket (e.g., a jack). In yet another implementation, the port 132 can include a media converter configured to connect an optical fiber to an electrical conductor.

In accordance with some aspects, the connector assembly 130 does not actively manage the primary signals S1. For example, in some implementations, the connector assembly 130 does not modify the primary data signal S1. Further, in some implementations, the connector assembly 130 does not read, store, or analyze the primary data signal S1.

In accordance with aspects of the disclosure, the connector assembly 130 also provides physical layer information (PLI) functionality as well as physical layer management (PLM) functionality through the transmission of secondary signals (see secondary signals S2 in FIG. 1). As the term is used herein, "PLI functionality" refers to the ability of a physical component or system to identify or otherwise associate physical layer information with some or all of the physical components implementing the system. As the term is used herein, "PLM functionality" refers to the ability of a component or system to manipulate or to enable others to manipulate the physical components of the system (e.g., to track what is connected to each component, to trace connections that are made using the components, or to provide visual indications to a user at a selected component) based on the physical layer information.

As the term is used herein, "physical layer information" refers to information about the identity, attributes, and/or status of the physical components of the communications system 101. In accordance with some aspects, physical layer information of a communications system can include media information, device information, network information, and location information.

As the term is used herein, media information refers to physical layer information pertaining to cables, plugs, connectors, and other such media segments. In accordance with some aspects, the media information is stored on or in the media segments, themselves. In accordance with other aspects, the media information can be stored at one or more data repositories for the communications system, either alternatively or in addition to the media, themselves. Non-limiting examples of media information include a part number, a serial number, a plug or other connector type, a conductor or fiber type, a cable or fiber length, cable polarity, a cable or fiber pass-through capacity, a date of manufacture, a manufacturing lot number, information about one or more visual attributes of physical communication media (e.g., information about the color or shape of the physical communication media or an image of the physical communication media), and an insertion count (i.e., a record of the number of times the media segment has been connected to another media segment). Media information also can include testing or media quality or performance information. The testing or media quality or performance information, for example, can be the results of testing that is performed when a particular segment of media is manufactured.

Device information refers to physical layer information pertaining to the communications panels, inter-networking devices, media converters, computers, servers, wall outlets, and other physical communications devices to which the media segments attach. In accordance with some aspects, the device information is stored on or in the devices, themselves. In accordance with other aspects, the device information can be stored at one or more data repositories for the communications system, either alternatively or in addition to the devices, themselves. Non-limiting examples of device information include a device identifier, a device type, port priority data (that associates a priority level with each port), and port updates (described in more detail herein).

Network information refers to physical layer information pertaining to the communications network. In accordance with some aspects, the network information is stored on or in network components implementing the network. In accordance with other aspects, the network information can be stored at one or more data repositories for the communications system, either alternatively or in addition to the network components, themselves. Non-limiting examples of network information includes virtual location identifiers for switches, splitters, routers, and other such networking components and signal routing paths.

Location information refers to physical layer information pertaining to a physical layout of a building or buildings in which the network is deployed. Location information also can include information indicating where each communications device, media segment, network component, or other component that is physically located within the building. In accordance with some aspects, the location information of each system component is stored on or in the respective component. In accordance with other aspects, the location information can be stored at one or more data repositories for the communications system, either alternatively or in addition to the system components, themselves.

In accordance with some aspects, the connector assembly 130 is configured to provide and/or acquire physical layer information about the communications network to and from a data network 140 (see secondary signals S2 in FIG. 1). In one example implementation, the data network 140 can include an existing Internet Protocol Network. In other implementations, the data network 140 can be uniquely designed for the communications network system 101.

The data network 140 (see secondary signals S2) is implemented separately from the communications network 101 (see primary signals S1). For example, in accordance with some aspects, the primary signals S1 do not propagate along the same media segments as the secondary signals S2. However, some or all of the devices implementing the communications system 101 can be connected to the data network 140. The data network 140 enables the physical layer information (secondary signals S2) to be communicated to any of the components connected to the data network 140 for storage and/or processing. Non-limiting examples of such data network components include other connector assemblies 130', an aggregation point 150 (described in greater detail herein), and a conventional computer system 160.

In accordance with some aspects, the connector assembly 130 includes a media reading interface 134 that is configured to read media information stored on or in the physical communications media segments retained within the port 132. For example, in some implementations, the connector assembly 130 can read media information stored on the media cables 105, 115. In other implementations, the connector assembly 130 can read media information stored on the connectors or plugs 110, 120 terminating the cables 105, 115, respectively.

The physical layer information is passed between the media reading interface 134 and the data network 140 via secondary signals S2.

Some implementations of the connector assembly 130 include a memory in which to store the physical layer information. For example, in certain implementations, the memory can store media information. The memory also can store device information pertaining to the connector assembly 130, network information pertaining to the communications network in which the connector assembly 130 is implemented, and/or location information pertaining to the building in which the connector assembly 130 is physically located.

In some implementations, the device information, network information, and/or location information can be obtained by the connector assembly 130 from the network 140. In other implementations, the device information, network information, and/or location information can be obtained by the connector assembly 130 from a user at the connector assembly 130 and provided to the network 140 (as described in more detail herein). In still other implementations, some or all of the media information also can be acquired from the network 140 instead of at the media reading interface 134. For example, physical layer information pertaining to media that is not configured to store such information can be manually entered into the network 140 (e.g., at the connector assembly 130, at the computer 160, or at the aggregation point 150).

In accordance with some aspects of the disclosure, the communications panel 130 is configured to add, delete, and/or change the physical layer information stored in or on the segment of physical communication media 115, 125 (i.e., or the associated connectors 110, 120). For example, in some implementations, the media information stored in or on the segment of physical communication media 115, 125 can be updated to include the results of testing that is performed when a segment of physical media is installed or otherwise checked. In other implementations, such testing information is supplied to the aggregation point 150 for storage and/or processing. Modification of the media information does not affect the primary signals S1 passing through the panel 130.

In another example, the media information includes a count of the number of times that the media segment (i.e., or a plug or connector attached thereto) has been inserted into port 132. In such an example, the count stored in or on the media segment is updated each time the segment (i.e., or plug or connector) is inserted into port 132. This insertion count value can be used, for example, for warranty purposes (e.g., to determine if the connector has been inserted more than the number of times specified in the warranty) or for security purposes (e.g., to detect unauthorized insertions of the physical communication media).

Figure 2:
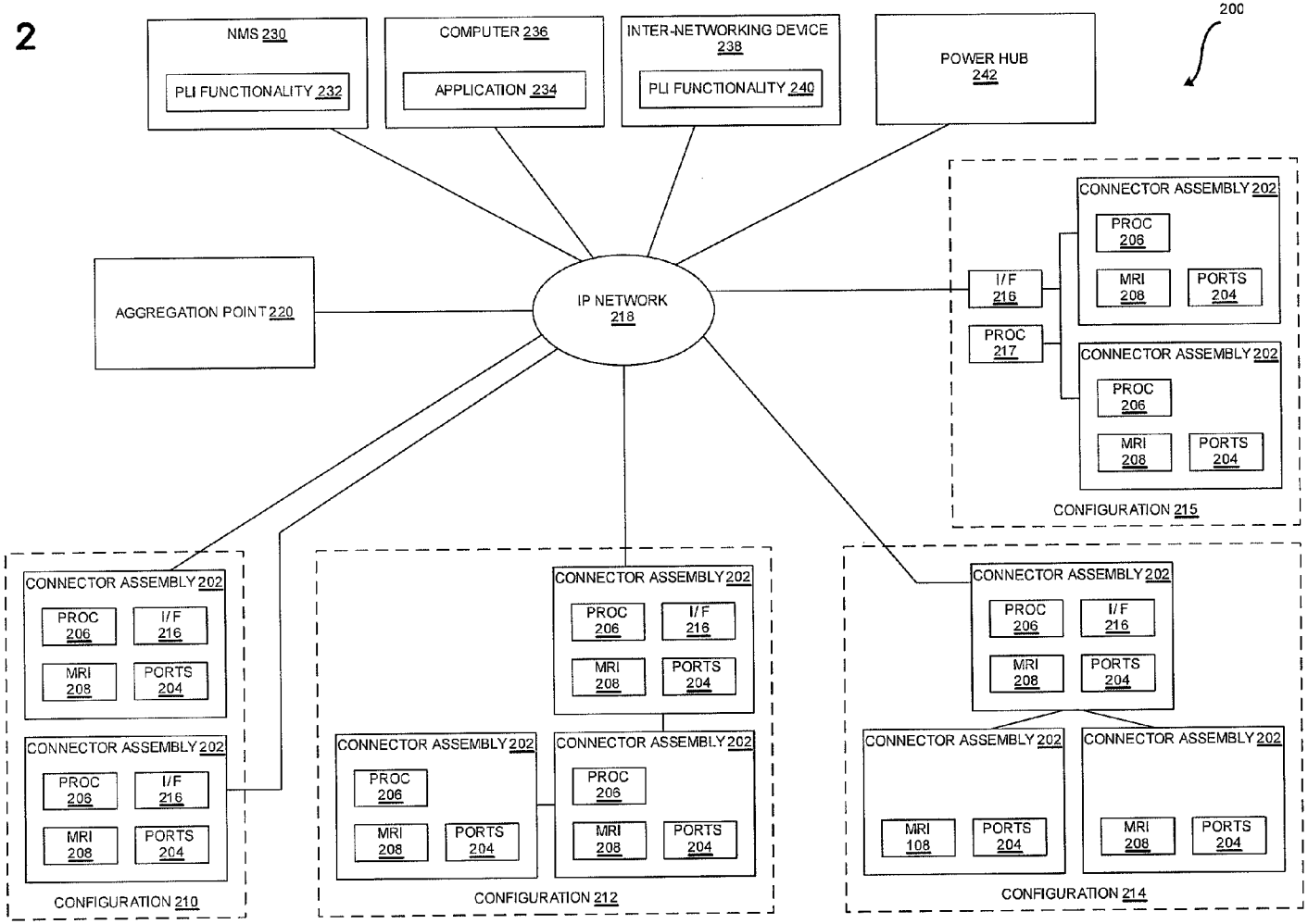
FIG. 2 is a block diagram of one embodiment of a communications management system that includes PLI functionality as well as PLM functionality in accordance with aspects of the present disclosure.

FIG. 2 is a block diagram of one example implementation of a communications management system 200 that includes PLI functionality as well as PLM functionality. The management system 200 comprises a plurality of connector assemblies 202. In general, the connector assemblies 202 are used to attach segments of physical communication media to one another. Non-limiting examples of connector assemblies 202 include, for example, rack-mounted connector assemblies (e.g., patch panels, distribution units, and media converters for fiber and copper physical communication media), wall-mounted connector assemblies (e.g., boxes, jacks, outlets, and media converters for fiber and copper physical communication media), and inter-networking devices (e.g., switches, routers, hubs, repeaters, gateways, and access points).

Each connector assembly 202 includes one or more ports 204, each of which is used to connect two or more segments of physical communication media to one another (e.g., to implement a portion of a logical communication link for primary signals S1 of FIG. 1). At least some of the connector assemblies 202 are designed for use with segments of physical communication media that have physical layer information (e.g., secondary signals S2 of FIG. 1) stored in or on them. The physical layer information is stored in or on the segment of physical communication media in a manner that enables the stored information, when the segment is attached to a port 204, to be read by a programmable processor 206 associated with the connector assembly 202.

In the particular implementation shown in FIG. 2, each of the ports 204 of the connector assemblies 202 comprises a respective media reading interface 208 via which the respective programmable processor 206 is able to determine if a physical communication media segment is attached to that port 204 and, if one is, to read the media information stored in or on the attached segment (if such media information is stored therein or thereon). The programmable processor 206 associated with each connector assembly 202 is communicatively coupled to each of the media reading interfaces 208 using a suitable bus or other interconnect (not shown).

In the particular implementation shown in FIG. 2, four example types of connector assembly configurations are shown. In the first connector assembly configuration 210 shown in FIG. 2, each connector assembly 202 includes its own respective programmable processor 206 and its own respective network interface 216 that is used to communicatively couple that connector assembly 202 to an Internet Protocol (IP) network 218.

In the second type of connector assembly configuration 212, a group of connector assemblies 202 are physically located near each other (e.g., in a bay or equipment closet). Each of the connector assemblies 202 in the group includes its own respective programmable processor 206. However, in the second connector assembly configuration 212, some of the connector assemblies 202 (referred to here as "interfaced connector assemblies") include their own respective network interfaces 216 while some of the connector assemblies 202 (referred to here as "non-interfaced connector assemblies") do not. The non-interfaced connector assemblies 202 are communicatively coupled to one or more of the interfaced connector assemblies 202 in the group via local connections. In this way, the non-interfaced connector assemblies 202 are communicatively coupled to the IP network 218 via the network interface 216 included in one or more of the interfaced connector assemblies 202 in the group. In the second type of connector assembly configuration 212, the total number of network interfaces 216 used to couple the connector assemblies 202 to the IP network 218 can be reduced. Moreover, in the particular implementation shown in FIG. 2, the non-interfaced connector assemblies 202 are connected to the interfaced connector assembly 202 using a daisy chain topology (though other topologies can be used in other implementations and embodiments).

In the third type of connector assembly configuration 214, a group of connector assemblies 202 are physically located near each other (e.g., within a bay or equipment closet). Some of the connector assemblies 202 in the group (also referred to here as "master" connector assemblies 202) include both their own programmable processors 206 and network interfaces 216, while some of the connector assemblies 202 (also referred to here as "slave" connector assemblies 202) do not include their own programmable processors 206 or network interfaces 216. Each of the slave connector assemblies 202 is communicatively coupled to one or more of the master connector assemblies 202 in the group via one or more local connections. The programmable processor 206 in each of the master connector assemblies 202 is able to carry out the PLM functions for both the master connector assembly 202 of which it is a part and any slave connector assemblies 202 to which the master connector assembly 202 is connected via the local connections. As a result, the cost associated with the slave connector assemblies 202 can be reduced. In the particular implementation shown in FIG. 2, the slave connector assemblies 202 are connected to a master connector assembly 202 in a star topology (though other topologies can be used in other implementations and embodiments).

Each programmable processor 206 is configured to execute software or firmware that causes the programmable processor 206 to carry out various functions described below. Each programmable processor 206 also includes suitable memory (not shown) that is coupled to the programmable processor 206 for storing program instructions and data. In general, the programmable processor 206 determines if a physical communication media segment is attached to a port 204 with which that processor 206 is associated and, if one is, to read the identifier and attribute information stored in or on the attached physical communication media segment (if the segment includes such information stored therein or thereon) using the associated media reading interface 208.

In the fourth type of connector assembly configuration 215, a group of connector assemblies 202 are housed within a common chassis or other enclosure. Each of the connector assemblies 202 in the configuration 215 includes their own programmable processors 206. In the context of this configuration 215, the programmable processors 206 in each of the connector assemblies are "slave" processors 206. Each of the slave programmable processor 206 is also communicatively coupled to a common "master" programmable processor 217 (e.g., over a backplane included in the chassis or enclosure). The master programmable processor 217 is coupled to a network interface 216 that is used to communicatively couple the master programmable processor 217 to the IP network 218.

In this configuration 215, each slave programmable processor 206 is configured to determine if physical communication media segments are attached to its port 204 and to read the physical layer information stored in or on the attached physical communication media segments (if the attached segments have such information stored therein or thereon) using the associated media reading interfaces 208. The physical layer information is communicated from the slave programmable processor 206 in each of the connector assemblies 202 in the chassis to the master processor 217. The master processor 217 is configured to handle the processing associated with communicating the physical layer information read from by the slave processors 206 to devices that are coupled to the IP network 218.

The system 200 includes functionality that enables the physical layer information that the connector assemblies 202 capture to be used by application-layer functionality outside of the traditional physical-layer management application domain. That is, the physical layer information is not retained in a PLM "island" used only for PLM purposes but is instead made available to other applications. In the particular implementation shown in FIG. 2, the management system 200 includes an aggregation point 220 that is communicatively coupled to the connector assemblies 202 via the IP network 218.

The aggregation point 220 includes functionality that obtains physical layer information from the connector assemblies 202 (and other devices) and stores the physical layer information in a data store. The aggregation point 220 can be used to receive physical layer information from various types of connector assemblies 202 that have functionality for automatically reading information stored in or on the segment of physical communication media. Also, the aggregation point 220 and aggregation functionality 224 can be used to receive physical layer information from other types of devices that have functionality for automatically reading information stored in or on the segment of physical communication media. Examples of such devices include end-user devices—such as computers, peripherals (e.g., printers, copiers, storage devices, and scanners), and IP telephones—that include functionality for automatically reading information stored in or on the segment of physical communication media.

The aggregation point 220 also can be used to obtain other types of physical layer information. For example, in this implementation, the aggregation point 220 also obtains information about physical communication media segments that is not otherwise automatically communicated to an aggregation point 220. This information can be provided to the aggregation point 220, for example, by manually entering such information into a file (e.g., a spreadsheet) and then uploading the file to the aggregation point 220 (e.g., using a web browser) in connection with the initial installation of each of the various items. Such information can also, for example, be directly entered using a user interface provided by the aggregation point 220 (e.g., using a web browser).

The aggregation point 220 also includes functionality that provides an interface for external devices or entities to access the physical layer information maintained by the aggregation point 220. This access can include retrieving information from the aggregation point 220 as well as supplying information to the aggregation point 220. In this implementation, the aggregation point 220 is implemented as "middleware" that is able to provide such external devices and entities with transparent and convenient access to the PLI maintained by the access point 220. Because the aggregation point 220 aggregates PLI from the relevant devices on the IP network 218 and provides external devices and entities with access to such PLI, the external devices and entities do not need to individually interact with all of the devices in the IP network 218 that provide PLI, nor do such devices need to have the capacity to respond to requests from such external devices and entities.

For example, as shown in FIG. 2, a network management system (NMS) 230 includes PLI functionality 232 that is configured to retrieve physical layer information from the aggregation point 220 and provide it to the other parts of the NMS 230 for use thereby. The NMS 230 uses the retrieved physical layer information to perform one or more network management functions. The NMS 230 communicates with the aggregation point 220 over the IP network 218.

As shown in FIG. 2, an application 234 executing on a computer 236 can also use the API implemented by the aggregation point 220 to access the PLI information maintained by the aggregation point 220 (e.g., to retrieve such information from the aggregation point 220 and/or to supply such information to the aggregation point 220). The computer 236 is coupled to the IP network 218 and accesses the aggregation point 220 over the IP network 218.

In the example shown in FIG. 2, one or more inter-networking devices 238 used to implement the IP network 218 include physical layer information (PLI) functionality 240. The PLI functionality 240 of the inter-networking device 238 is configured to retrieve physical layer information from the aggregation point 220 and use the retrieved physical layer information to perform one or more inter-networking functions. Examples of inter-networking functions include Layer 1, Layer 2, and Layer 3 (of the OSI model) inter-networking functions such as the routing, switching, repeating, bridging, and grooming of communication traffic that is received at the inter-networking device.

The aggregation point 220 can be implemented on a standalone network node (e.g., a standalone computer running appropriate software) or can be integrated along with other network functionality (e.g., integrated with an element management system or network management system or other network server or network element). Moreover, the functionality of the aggregation point 220 can be distribute across many nodes and devices in the network and/or implemented, for example, in a hierarchical manner (e.g., with many levels of aggregation points). The IP network 218 can include one or more local area networks and/or wide area networks (e.g., the Internet). As a result, the aggregation point 220, NMS 230, and computer 236 need not be located at the same site as each other or at the same site as the connector assemblies 202 or the inter-networking devices 238.

Also, power can be supplied to the connector assemblies 202 using conventional "Power over Ethernet" techniques specified in the IEEE 802.3af standard, which is hereby incorporated herein by reference. In such an implementation, a power hub 242 or other power supplying device (located near or incorporated into an inter-networking device that is coupled to each connector assembly 202) injects DC power onto one or more of the wires (also referred to here as the "power wires") included in the copper twisted-pair cable used to connect each connector assembly 202 to the associated inter-networking device.

Figure 3:
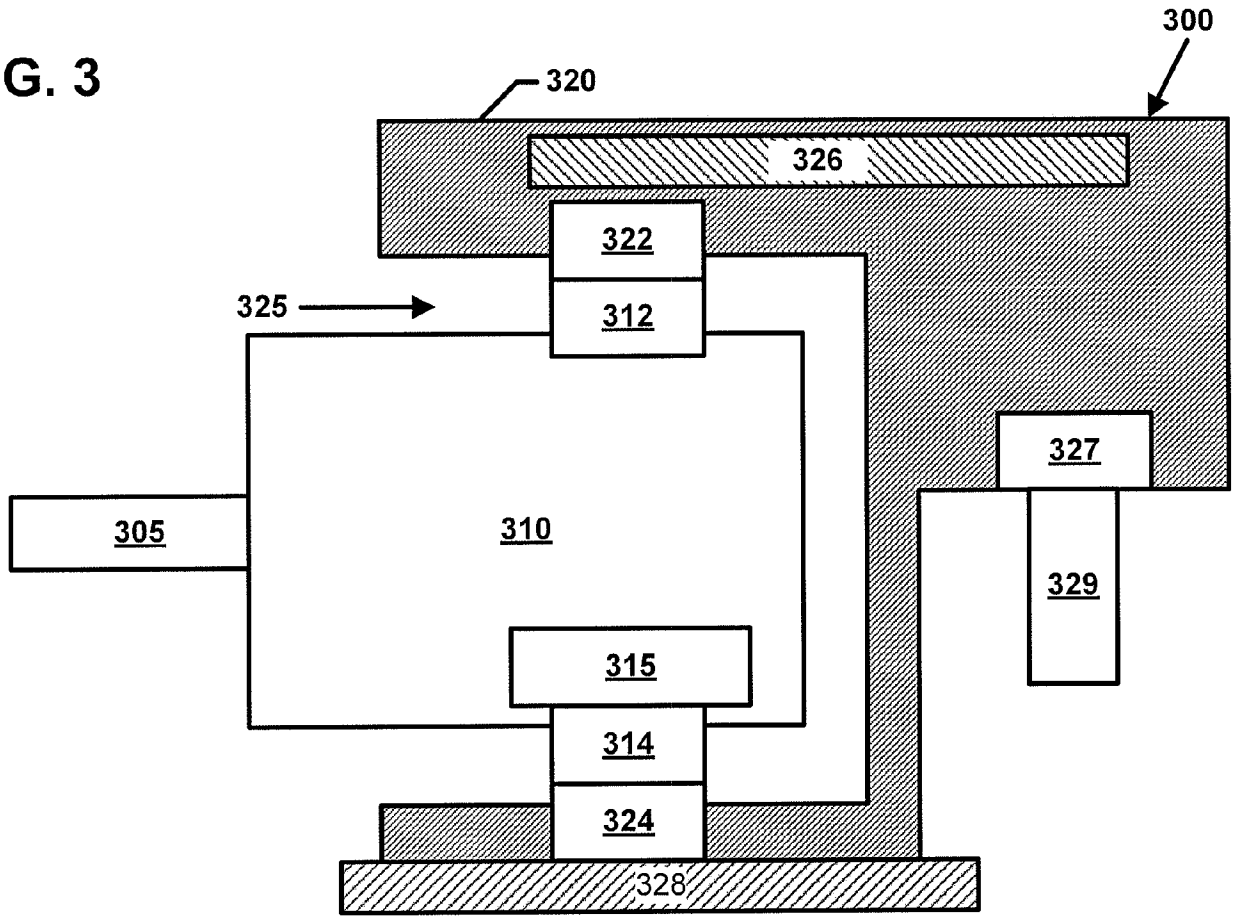
FIG. 3 is a schematic diagram of one example physical layer management system including a connector arrangement (e.g., an electrical plug) and a connector assembly (e.g., jack module) in accordance with aspects of the present disclosure.

FIG. 3 is a schematic diagram of one example physical layer management system 300 including a connector arrangement (e.g., an electrical plug) 310 and a connector assembly (e.g., jack module) 320. The connector arrangement 310 terminates at least a first electrical segment (e.g., a conductor cable) 305 of physical communications media and the connector assembly 320 terminates at least second electrical segments (e.g., twisted pairs of copper wires) 329 of physical communications media. The connector assembly 320 defines at least one socket port 325 in which the connector arrangement 310 can be accommodated.

Each electrical segments 305 of the connector arrangement 310 carry primary communication signals (e.g., see primary signals S1 of FIG. 1) to primary contact members 312 on the connector arrangement 310. The connector assembly 320 includes a primary contact arrangement 322 that is accessible from the socket port 325. The primary contact arrangement 322 is aligned with and configured to interface with the primary contact members 312 to receive the primary signals (S1 of FIG. 1) from the primary contact members 312 when the connector arrangement 310 is inserted into the socket 325 of the connector assembly 320.

The connector assembly 320 is electrically coupled to one or more printed circuit boards. For example, the connector assembly 320 can support or enclose a first printed circuit board 326, which connects to insulation displacement contacts (IDCs) 327 or to another type of electrical contacts. The IDCs 327 terminate the electrical segments 329 of physical communications media (e.g., conductive wires). The first printed circuit board 326 manages the primary communication signals carried from the conductors terminating the cable 305 to the electrical segments 329 that couple to the IDCs 327.

In accordance with some aspects, the connector arrangement 310 can include a storage device 315 configured to store PLI signals (e.g., secondary signals S2 of FIG. 1). The connector arrangement 310 also includes second contact members 314 that are electrically coupled (i.e., or otherwise communicatively coupled) to the storage device 315. In one implementation, the storage device 315 is implemented using an EEPROM (e.g., a PCB surface-mount EEPROM). In other implementations, the storage device 315 is implemented using other non-volatile memory device. Each storage device 315 is arranged and configured so that it does not interfere or interact with the primary signals S1 communicated over the media segment.

The connector assembly 320 also includes a second contact arrangement (e.g., a media reading interface) 324. In certain implementations, the media reading interface 324 is accessible through the socket port 325. The second contact arrangement 324 is aligned with and configured to interface with the second contact members 314 of the media segment to receive the PLI signals (e.g., secondary signals S2 of FIG. 1) from the storage device 315 when the connector arrangement 310 is inserted into the socket 325 of the connector assembly 320.

In some such implementations, the storage device interfaces 314 and the media reading interfaces 324 each comprise three (3) leads—a power lead, a ground lead, and a data lead. The three leads of the storage device interface 314 come into electrical contact with three (3) corresponding leads of the media reading interface 324 when the corresponding media segment is inserted in the corresponding port 325. In certain example implementations, a two-line interface is used with a simple charge pump. In still other implementations, additional leads can be provided (e.g., for potential future applications). Accordingly, the storage device interfaces 314 and the media reading interfaces 324 may each include four (4) leads, five (5) leads, six (6) leads, etc.

The storage device 315 also may include a processor or micro-controller, in addition to the storage for the PLI signals. In some example implementations, the micro-controller can be used to execute software or firmware that, for example, performs an integrity test on the cable 305 (e.g., by performing a capacitance or impedance test on the sheathing or insulator that surrounds the cable 305, (which may include a metallic foil or metallic filler for such purposes)). In the event that a problem with the integrity of the cable 305 is detected, the micro-controller can communicate that fact to the programmable processor 206 associated with the port 204 using the storage device interface (e.g., by raising an interrupt) (FIG. 2). The micro-controller also can be used for other functions.

The connector assembly 320 also can support or enclose a second printed circuit board 328, which connects to the second contact arrangement 324. The second printed circuit board 328 manages the PLI signals communicated from a storage device 315 through second contacts 314, 324. In the example shown, the second printed circuit board 328 is positioned on an opposite side of the connector assembly 320 from the first printed circuit board 326. In other implementations, the printed circuit boards 326, 328 can be positioned on the same side or on different sides. In one implementation, the second printed circuit board 328 is positioned horizontally relative to the connector assembly 320 (see FIG. 3). In another implementation, the second printed circuit board 328 is positioned vertically relative to the connector assembly 320.

The second printed circuit board 328 can be communicatively connected to one or more programmable electronic processors and/or one or more network interfaces. In one implementation, one or more such processors and interfaces can be arranged as components on the printed circuit board 328. In another implementation, one of more such processor and interfaces can be arranged on a separate circuit board that is coupled to the second printed circuit board 328. For example, the second printed circuit board 328 can couple to other circuit boards via a card edge type connection, a connector-to-connector type connection, a cable connection, etc.

FIGS. 4-19 provide an example implementation of components for electrical (e.g., copper) communications applications in physical layer management networks. FIGS. 4-7 show an example of a connector arrangement 400 configured to be received, for signal transmission, within a port of a connector assembly, such as connector assembly 500 (FIG. 7). In accordance with one aspect, the connector arrangement 400 includes a plug 402, such as an RJ plug, that connects to the end of an electrical segment of telecommunications media, such as twisted pair copper cable 480. In one embodiment, a shield can be mounted to the plug nose body 404. For example, the shield can be snap-fit to the plug nose body 404.

The plug 402 includes a plug nose body 404 configured to hold at least main signal contacts 412. The plug 402 also includes a wire manager 408 for managing the twisted wire pairs and a strain relief boot 410. For example, the plug nose body 404 defines one or more openings 405 in which lugs on the wire manager 408 can latch. In accordance with some aspects, the wire manager 408 and boot 410 are integrally formed. In another implementation, the boot 410 can be connected to the wire manager 408 via a rotation-latch mechanism. In other implementations, the boot 410 can otherwise secure to the wire manager 408.

Figure 5:
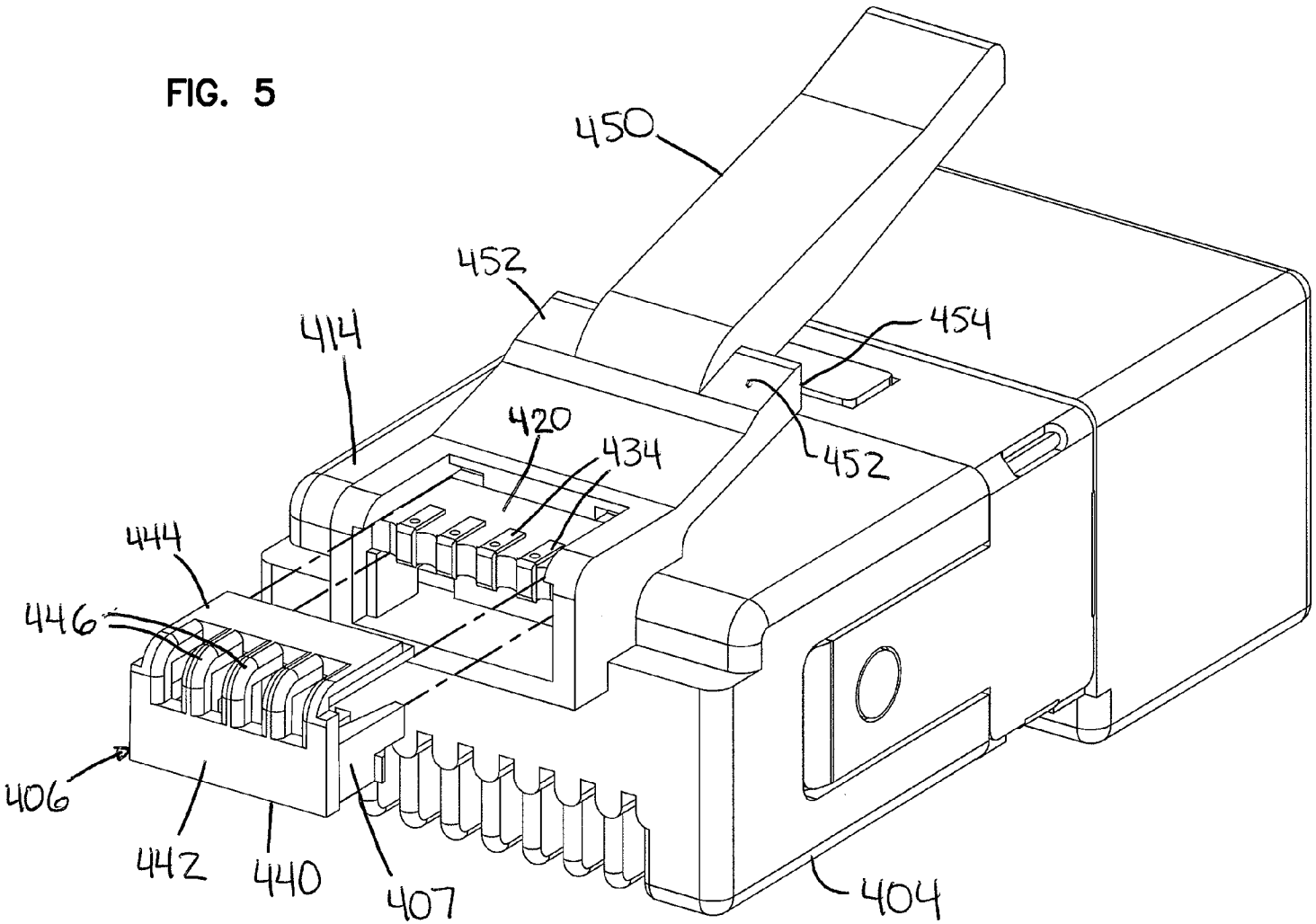
Figure 6:
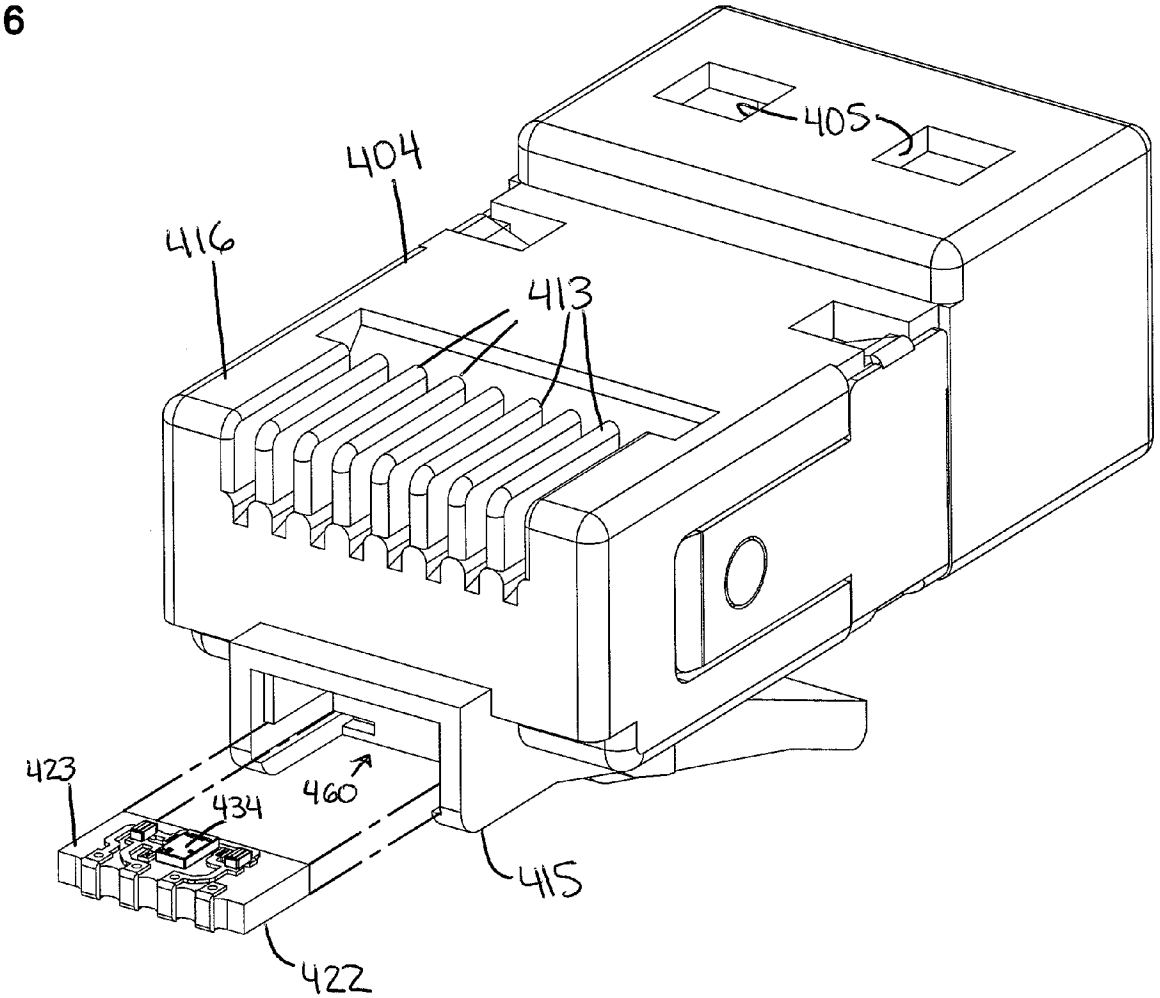
Figure 7:
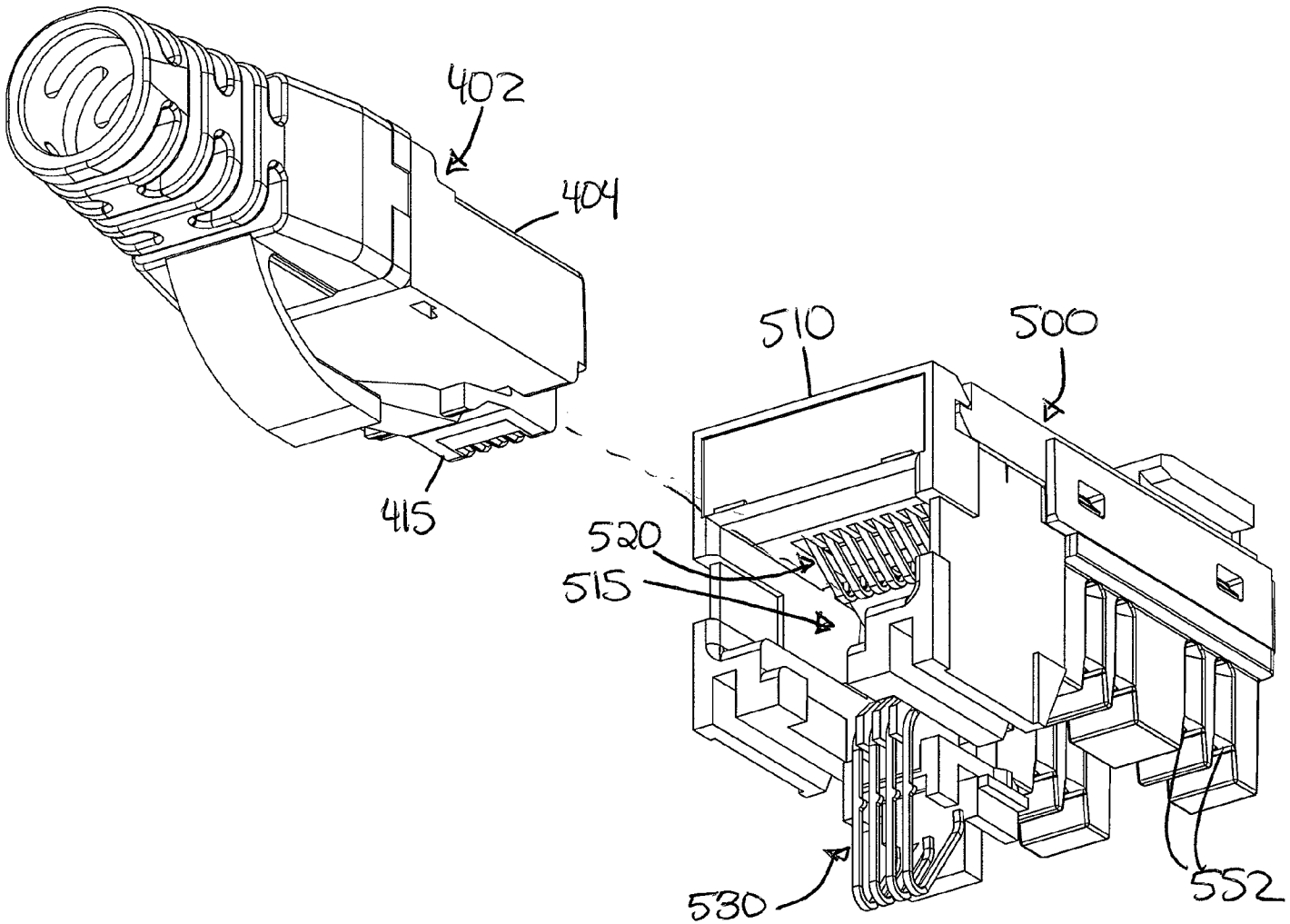
FIG. 7 shows one example connector assembly including a jack module in accordance with aspects of the present disclosure.

In the example shown, the plug nose body 404 has a first side 414 (FIG. 5) and a second side 416 (FIG. 6). The first side 414 of the plug nose body 404 includes a key member 415 (FIG. 6) and a finger tab 450 (FIG. 5) that extends outwardly from the key member 415. The key member 415 and finger tab 450 facilitates aligning and securing the connector arrangement 400 to a connector assembly as will be described in more detail herein. In certain implementations, the finger tab 450 attaches to the plug nose body 404 at the key member 415. In one implementation, the finger tab 450 and at least a portion of the key member 415 are unitary with the plug nose body 404.

The finger tab 450 is sufficiently resilient to enable a distal end 451 of the finger tab 450 to flex or pivot toward and away from the plug nose body 404. Certain types of finger tabs 450 include at least one cam follower surface 452 and a latch surface 454 for latching to the connector assembly as will be described in more detail herein. In certain implementations, the finger tab 450 includes two cam follower surfaces 452 located on either side of a handle extension 453 (see FIG. 5). Depressing the handle extension 453 moves the latch surfaces 454 toward the plug nose body 404. In certain implementations, the wire manager 408 and/or boot 410 include a flexible grip surface 411 that curves over at least the distal end 451 of the handle extension 453 to facilitate depressing of the handle extension 453 (e.g., see FIG. 4).

The second side 416 of the plug nose body 404 is configured to hold main signal contacts 412, which are electrically connected to the twisted pair conductors of the telecommunications cable 480. Ribs 413 protect the main signal contacts 412. In the example shown, the plug 402 is insertable into a port of a mating jack of a connector assembly, such as jack module 510 (see FIG. 7). The main signal contacts 412 are configured to electrically connect to contacts 520 positioned in the jack module 510 for signal transmission.

The connector arrangement 400 also includes a storage device 430 (FIG. 6) that is configured to store information (e.g., an identifier and/or attribute information) pertaining to the segment of physical communications media (e.g., the plug 402 and/or the electrical cable 480 terminated thereby). In one implementation, the media storage device 430 includes an EEPROM 432. Circuit contacts 434 (FIG. 5) of the storage device 430 permit connection of the EEPROM 432 to a media reading interface, such as media reading interface 530 shown in FIG. 7. In other implementations, however, the storage device 430 can include any suitable type of memory.

In some implementations, the storage device 430 is mounted to or accommodated within the modular plug 402 (see FIG. 5). For example, the storage device 430 can be mounted to a circuit board 420, which can be positioned on or in the plug nose body 404 of connector arrangement 400. In some implementations, the circuit board 420 is mounted to an exterior surface of the plug body 404. In other implementations, however, the circuit board 420 is mounted within a cavity defined in the plug body 404 (see FIG. 5). For example, in certain implementations, the plug nose body 404 defines a cavity 460 (FIG. 6) at a front 401 of the body 404. In the example shown, the printed circuit board 420 can be slid along guide grooves 467 defined within the cavity 460 from the front 401 of the plug nose body 404 (see FIG. 6). In other implementations, the printed circuit board 420 can be latched, glued, or otherwise secured within the cavity 460.

Figure 4:
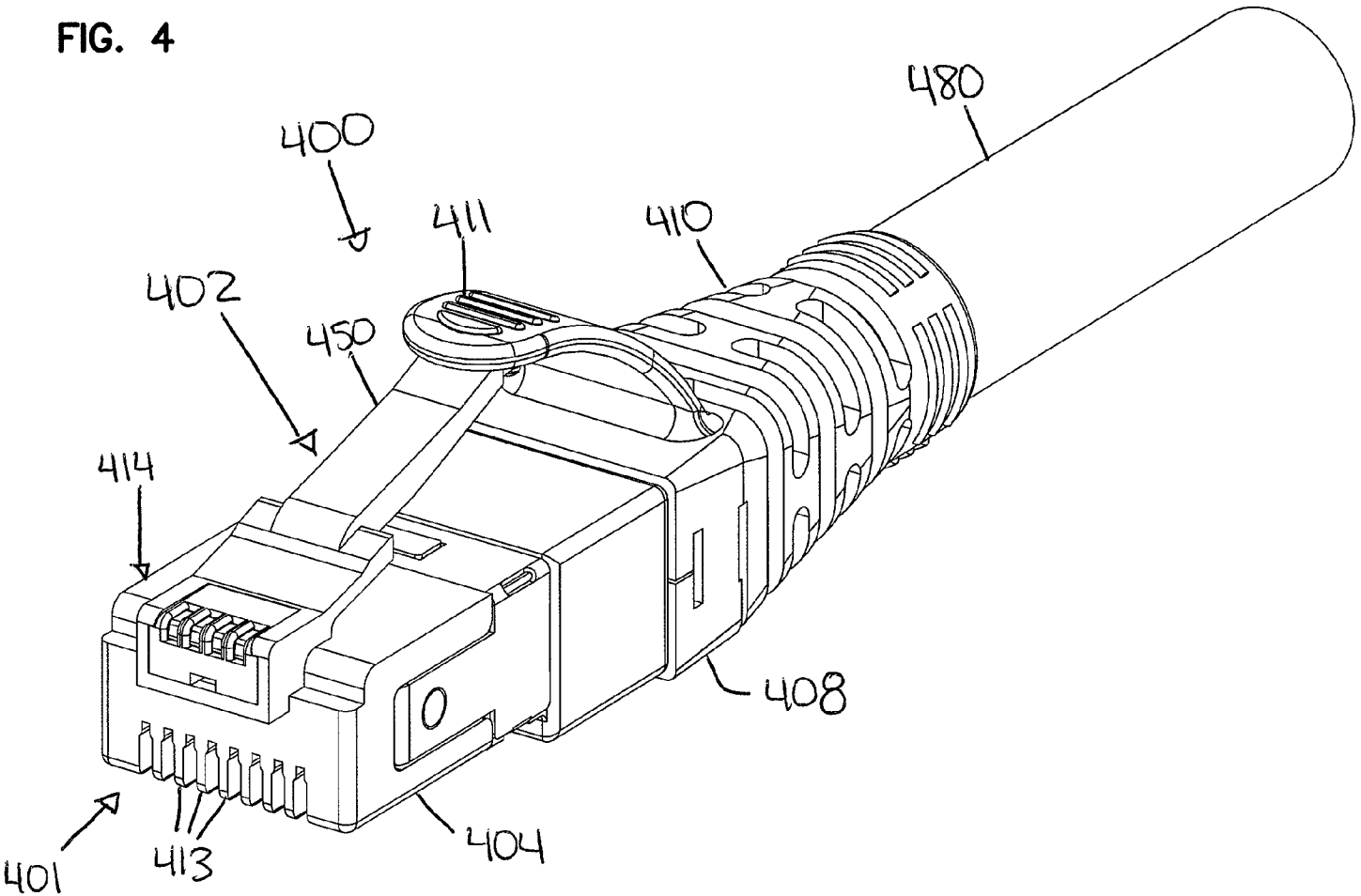
FIGS. 4-6 show a first example of a connector arrangement for terminating an electrical segment of telecommunications media in accordance with aspects of the present disclosure.

In the example shown, a cover section 406 covers or closes the open cavity 460 (see FIGS. 4 and 5). The cover section 406 includes a body 440 defining ribs 446 that provide access to contacts 434 of the storage device 430 within the cavity 460. For example, in one implementation, contacts of a media reading interface 530 on a patch panel or jack module 510 can extend through the ribs 446 to connect to the circuit contacts 434 on the storage device 430.

FIG. 7 shows one example connector assembly 500 including a jack module 510. The example jack module 510 defines a socket 515 into which the plug 402 can be inserted through an open port. The jack module 510 also includes or accommodates a first contact arrangement 520 and a second contact arrangement 530. In the example shown, the second contact arrangement 530 is located on an opposite side of the jack 510 from the first contact arrangement 520. In other implementations, however, the contact arrangements 520, 530 can be positioned on the same side or on different, but not opposite, sides.

Contacts of the first contact arrangement 520 of the jack module 510 are configured to interface with the main signal contacts 412 on the plug 402 when the plug 402 is inserted into the socket 515 of the jack module 510. The jack module 510 also includes a first section 512 configured to support or enclose a first printed circuit board, which connects the first contact arrangement 520 to insulation displacement contacts (IDCs) 552 for signal transmission therebetween. Accordingly, inserting the plug 402 into the socket 515 connects the conductors of the electrical cable 480 with other conductors terminated at the IDCs 552. More specifically, inserting the plug 402 into the socket 515 brings the main signal contacts 412 of the plug 402 into contact with the first contact arrangement 520 of the jack module 510, thereby establishing an electrical connection therebetween.

Contacts of the second contact arrangement 530, which form a media reading interface, are configured to electrically connect to the contacts 434 of the plug storage device 430 when the plug 402 is inserted into the socket 515 of the jack module 510. The jack module 510 also includes a second section that is configured to support a second printed circuit board, which connects the second contact arrangement 530 to a processor of a layer management system, such as programmable processor 106 of FIG. 1, for signal transmission therebetween. Accordingly, inserting the plug 402 into the socket 515 connects the storage device 430 on the plug 402 to the processor of the management system. More specifically, inserting the plug 402 into the socket 515 brings the contacts 434 on the plug storage device 430 into contact with the second contact arrangement 530 of the jack module 510, thereby establishing an electrical connection therebetween.

Figure 9:
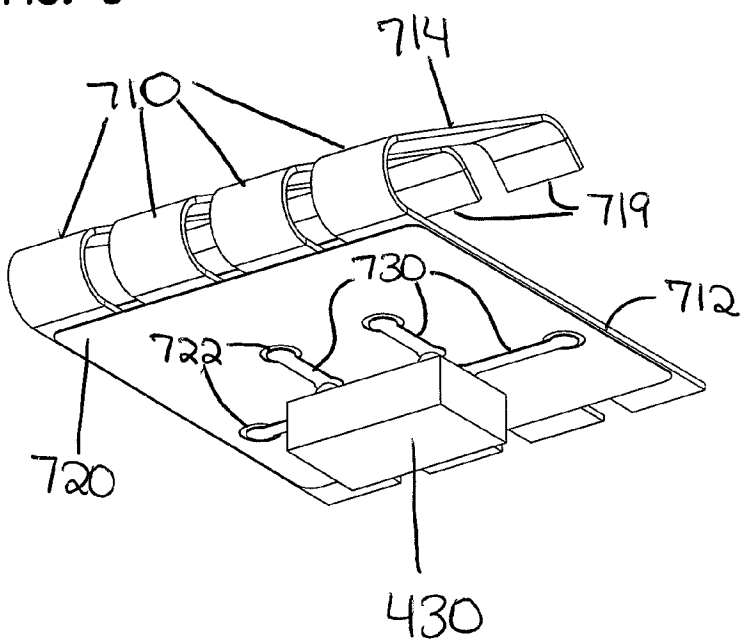
FIGS. 8-13 show a first example contact arrangement configured in accordance with aspects of the present disclosure.

FIGS. 8-31 illustrate other example implementations for mounting the storage device 430 to the plug 402. The storage device 430 can be mounted to a contact arrangement that is mounted to the plug 402. One example contact arrangement 700 is shown in FIGS. 8-13. The contact arrangement 700 includes an insulating surface 720 formed over one or more electrically conductive members 710 (FIG. 9). For example, the contact arrangement 700 can include a polymeric (e.g., polyimide) surface 720 formed over one or more stainless steel contact members 710.

The storage device 430 is positioned on a first side of the insulating surface 720 and the conductive members 710 are positioned on a second side of the insulating surface 720. For example, the storage device 430 can be positioned on an opposite side of the insulating surface 720 from the conductive members 710. The insulating surface 720 defines one or more openings or vias 722 through which the storage device 430 can electrically connect to the conductive members 710.

Tracings 730 can be applied to the first side of the insulating surface 720 and through the vias 722 to electrically connect the storage device 430 to the conductive members 710. In one implementation, the storage device 430 is soldered to landings of the tracings 730 in the insulating layer 720. In other implementations, the storage device 430 may otherwise be installed on the layer 720 to be in electrical communication with the tracings 730.

In some implementations, the insulating material forming the insulating layer 720 is a polymer (e.g., polyimide). In other implementations, however, the insulating material can include plastic, fiberglass, or any other non-conductive material. In various implementations, the insulating layer 720 is built to have a thickness T (FIG. 10) that ranges between 0.002 inches (51 μm) and 0.1 inches (2540 μm). Indeed, in some implementations, the thickness T of the insulating layer 720 ranges between 0.008 inches (203 μm) and 0.05 inches (1270 μm). In one example implementation, the thickness T of the insulating layer 720 is about 0.01 inches (254 μm). In another example implementation, the thickness T of the insulating layer 720 is about 0.02 inches (508 μm). In another example implementation, the thickness T of the insulating layer 720 is about 0.009 inches (229 μm). In other implementations, however, the insulating layer 720 can be thicker or thinner.

Figure 8:
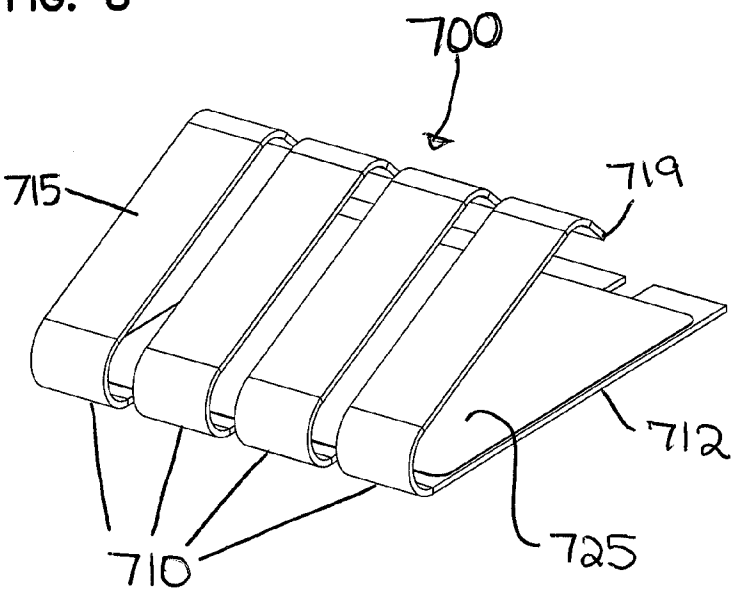
Figure 10:
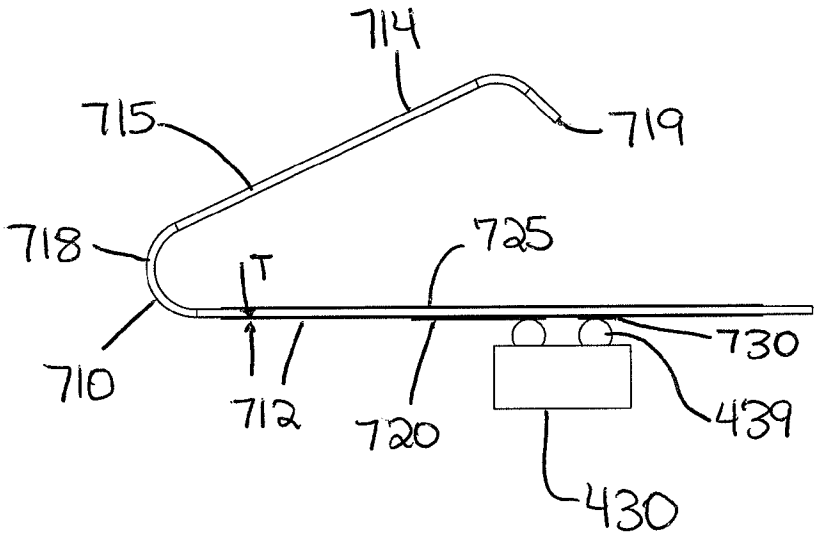
Figure 13:
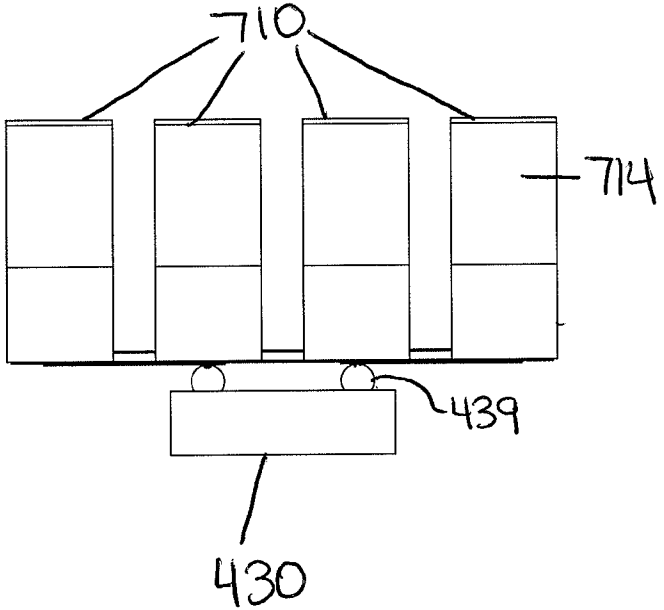
Figure 12:
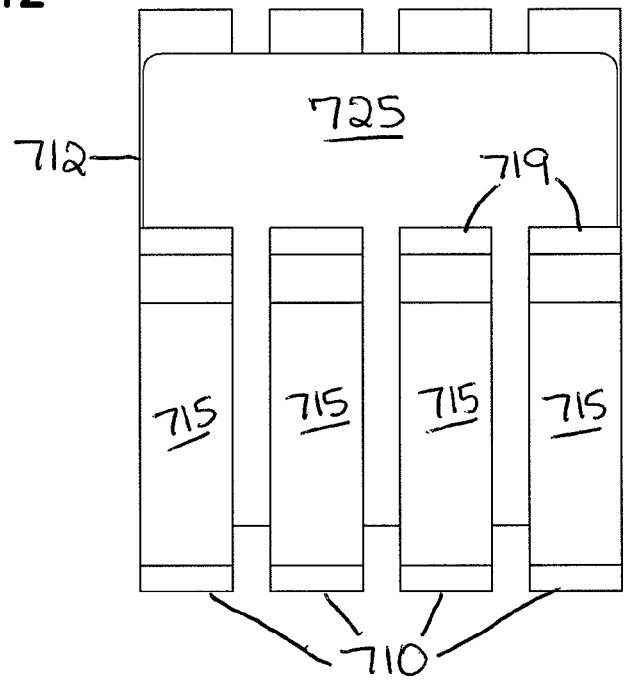

In certain implementations, a second insulating surface 725 can be formed on an opposite side of the conductive members 710 (FIG. 8). In some implementations, the second insulating surface 725 may increase the strength or sturdiness of the contact arrangement 700. In other implementations, the second insulating surface 725 may facilitate mounting the contact arrangement 700 on a plug (e.g., plug 402 of FIGS. 4-7). In one implementation, the second insulating layer 725 has generally the same thickness as the first insulating layer 720. In other implementations, however, the second insulating layer 725 can be thicker or thinner than the first insulating layer 720.

Each conductive member 710 defines a mounting section 712 and a contact section 714. The insulating surface 720 is coupled to the mounting section 712 of each conductive member 710. The contact sections 714 are shaped to define contact surfaces 715 for electrically connecting to a media reading interface of a jack module or other connector assembly (e.g., to media reading interface 324 of connector assembly 320 of FIG. 3). In certain implementations, portions of the contact surfaces 715 are plated with a conductive material (e.g., gold, copper, nickel, or alloy thereof) to further define the contact surfaces.

In some implementations, the contact members 714 of the conductive members 710 are shaped to provide spring contacts. For example, each contact member 714 shown in FIGS. 8-13 defines a bent or curved section 718 (FIG. 10) from which the contact surface 715 extends upwardly and at least partially across the second insulating surface 725 at an oblique angle to the insulating surface 725. Distal ends 719 of the contact sections 714 may bend or curve downwardly toward the second insulating surface 725 without touching the second insulating surface 725. The bent or curved section 718 may function as a spring when interfacing with contacts of a media reading interface of a connector assembly.

Figure 14:
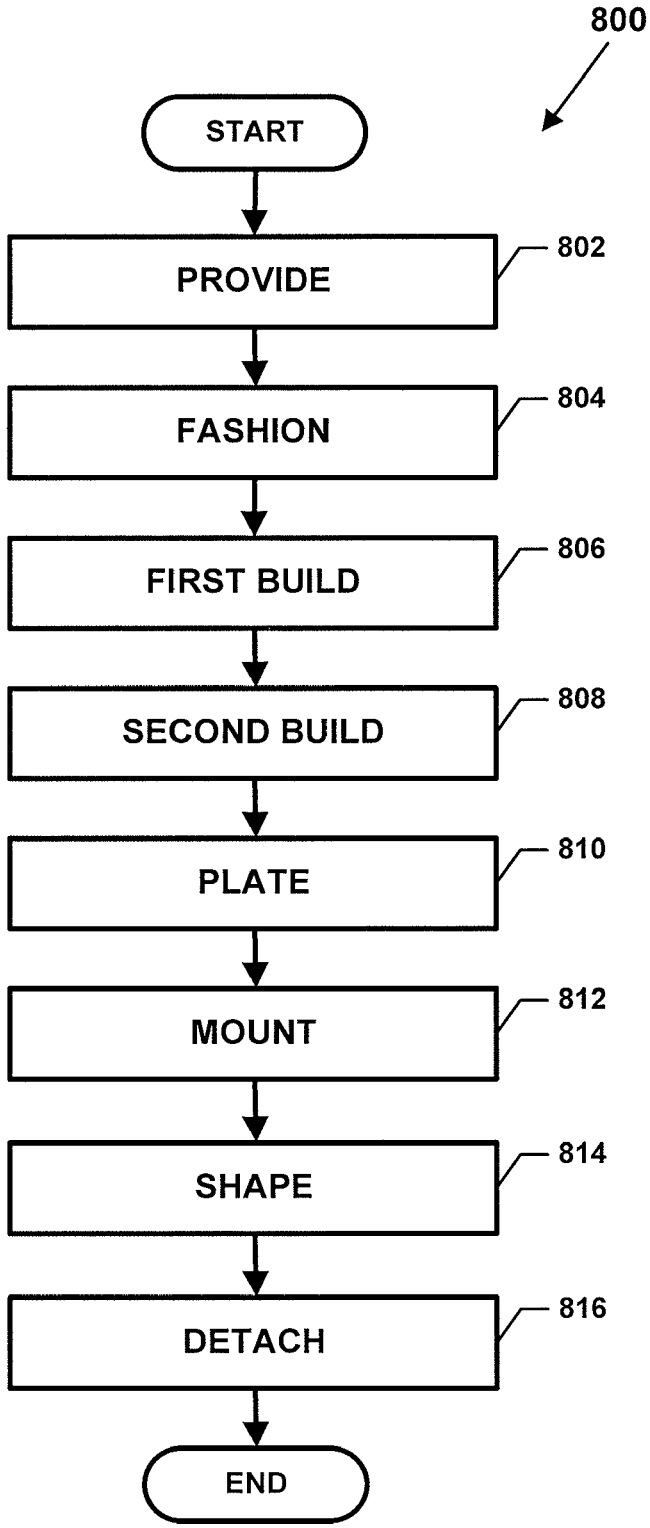
FIG. 14 is a flowchart showing steps for an example manufacturing process by which the above described contact arrangements can be manufactured in accordance with aspects of the present disclosure.

FIG. 14 is a flowchart showing steps for an example manufacturing process 800 by which the above described contact arrangements can be manufactured. For clarity, the manufacturing process 800 will be described with respect to the contact arrangement 700 of FIGS. 8-13. However, the manufacturing process 800 is suitable for forming any of the contact arrangements 700, 1000, 1100, 1200 described herein. FIGS. 15-19 illustrate the results of the manufacturing steps.

Figure 15:
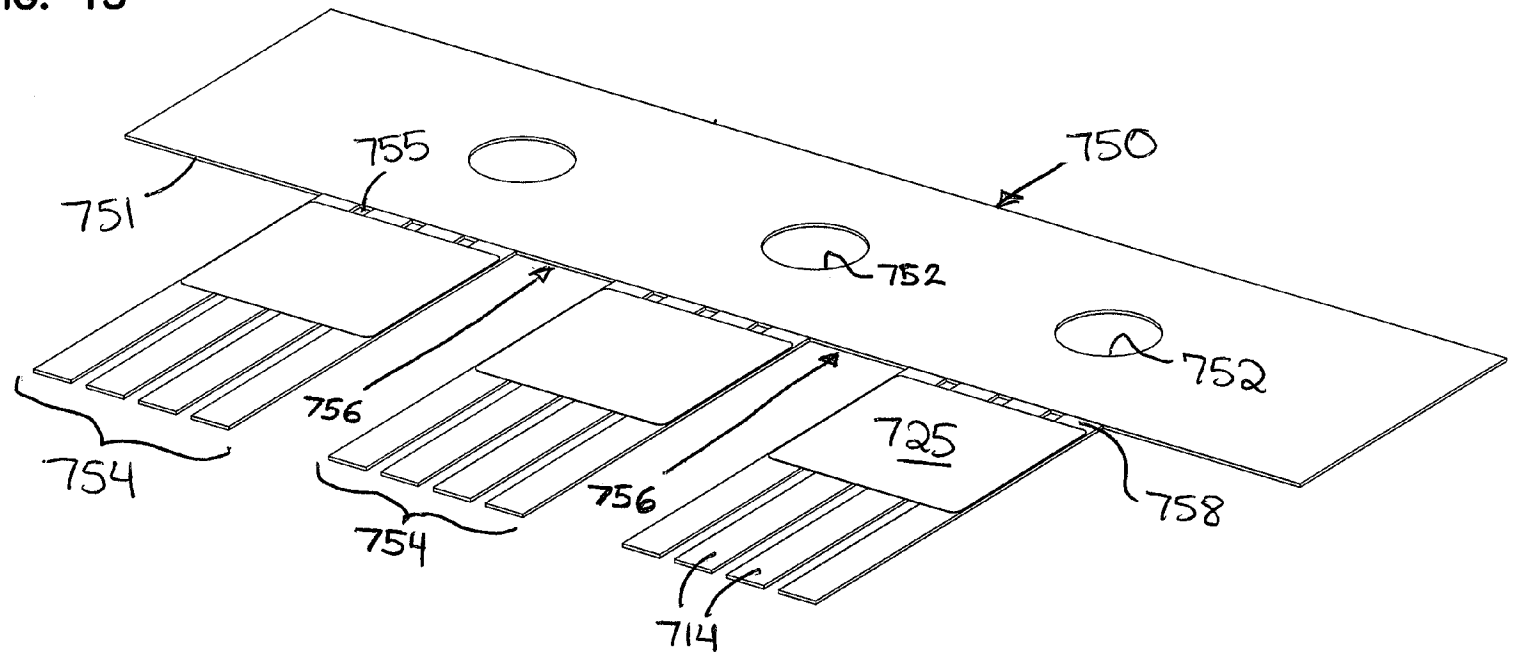
FIGS. 15-19 illustrate the results of the manufacturing steps of the manufacturing process of FIG. 14 in accordance with aspects of the present disclosure.
Figure 16:
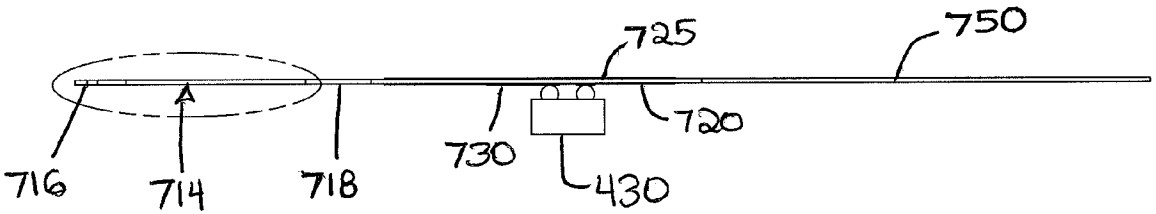

In manufacturing process 800, a user implements any suitable initial steps and then begins at a provide carrier step 802. In step 802, the user obtains (e.g., buys or makes) a strip 750 of conductive material (FIG. 15). In one implementation, the user obtains a strip 750 of stainless steel. In other implementations, the user can obtain a strip 750 of different conductive material (e.g., copper alloy). In one implementation, the conductive strip 750 defines a series of holes 752 or tracks along its length to facilitate moving the strip 750 through machinery (e.g., stamping or etching machinery).

One or more conductive members 710 are formed from the conductive strip 750 in fashion step 804. In some implementations, the conductive members 710 can be etched from the conductive strip 750. In other implementations, the conductive members 710 can be stamped from the conductive strip 750. In still other implementations, however, the fashion step 804 can include any suitable manufacturing process for adding or removing conductive material to the conductive strip 750 to form the conductive members 710.

In some implementations, the conductive members 710 extend from one side 751 of the carrier strip 750 (see FIG. 15). In other implementations, the conductive members 710 extend from opposite sides of the carrier strip 750. In still other implementations, the conductive members 710 can extend from more than two sides of the carrier strip 750.

The conductive members 710 are spaced apart by gaps 755. In some implementations, groups 754 of conductive members 710 are fashioned from the conductive strip 750 (See FIG. 15). For example, the groups 754 of conductive members 710 can be separated by gaps 756 that are greater than gaps 755 between the conductive members 710 in a group 754. In the example shown, each group 754 created during the fashion step 804 includes four conductive members 710. In other implementations, however, each group 754 can include greater or fewer conductive members 710.

Figure 11:
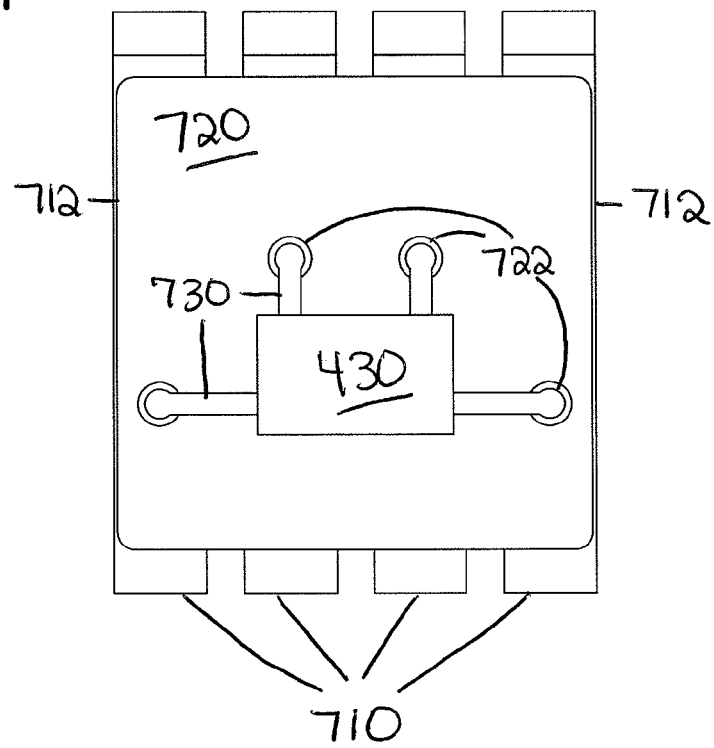

A first build step 806 creates an insulation layer 720 (FIG. 16) on one or more of the conductive members 710. For example, in some implementations, the first build step 806 can create an insulating layer 720 across the conductive members 710 of one of the groups 754 of conductive members 710. In some implementations, the first build step 806 applies an insulating material to select conductive members 710 with a stencil and roller. For example, the stencil can define positions at which the insulating material will not be applied, e.g., to define vias 722 (FIGS. 9 and 11). In other implementations, the insulating layer 710 can be otherwise applied.

The first build step 806 creates the insulating layer 720 over only a portion of the conductive members 710. A remaining portion or section 714 (see dashed oval of FIG. 16) of each conductive member 710 extends outwardly from the insulating layer 720 (see FIG. 15). In some implementations, the insulating layer 720 is formed so as to cover about half of the surface area of one side of the conductive members 710. In other implementations, the insulating layer 720 covers more or less than half of the first surface area. In one implementation, the first build step 806 leaves a gap between the insulating layer 720 and the conductive strip 750 to define tabs 758. Tabs 758 may facilitate separation of the contact arrangement 700 from the strip 750, e.g., as described below.

In some implementations, the first build step 806 also can create a second insulating layer 725 on an opposite side of the conductive members 710 (See FIG. 15). For example, the first build step 806 can add the second insulating layer 725 to increase the strength or sturdiness of the contact arrangement 700 or to facilitate mounting the contact arrangement 700 on a plug (e.g., plug 402 of FIGS. 4-7). In one implementation, the second insulating layer 725 has generally the same thickness as the first insulating layer 720. In other implementations, however, the second insulating layer 725 can be thicker or thinner than the first insulating layer 720.

A second build step 808 creates tracings 730 (FIG. 16) of the insulating layer 720. For example, in certain implementations, the second build step 808 forms the tracings 730 on the surface of the insulating layer and within the vias 722. In one implementation, the tracings 730 are formed from gold. In other implementations, the tracings 730 can be formed from any suitable conductive alloy (e.g., copper, nickel, gold, or alloys thereof).

The tracings 730 are arranged to provide a conductive path across the first side of the insulating layer 720 and through one of the vias 722 to the second side of the insulating layer 720, which contacts the conductive members 710. In some implementations, the second build step 808 forms a corresponding tracing 730 for each conductive member 710. In the example shown, the second build step 808 creates four tracings to correspond with the four conductive members 710. In other implementations, the second build step 808 forms a corresponding tracing 730 for each contact terminal on the storage device 430.

A plate step 810 coats each conductive member 710 with a conductive material that is different from the conductive material forming the strip 750. For example, contact surfaces 715 of the conductive member extensions 714 are plated with a material (e.g., gold, copper, nickel, or alloy thereof) that is more conductive than the base material of the conductive strip 750 and, accordingly, of the conductive members 710. The plated contact portions 715 facilitate an electrical connection between the conductive members 710 and the contacts of a media reading interface or other connection assembly contacts.

A mount step 812 aligns the contacts of the storage device 430 with landings of the tracings 730 and secures the storage device 430 to the first side of the insulating layer 720. In some implementations, the mount step 812 positions the storage device 430 on the insulating layer 720 (e.g., with a fixture) and places the entire apparatus in a vapor oven to set. In other implementations, the groups 754 of conductive members 710 can be detached from the conductive strip 750 and the groups 754 can be separately placed in the vapor oven.

In one implementation, separate fixtures (e.g., a fixing plate) can hold the storage devices 430 to the insulating layers 720 (e.g., in transit to the vapor oven, within the vapor oven, etc.). In another implementation, a single fixture can hold all of the storage devices 430 to the insulating layers 720. In other implementations, the mount step 812 secures the storage device 430 to the insulating layer 720 with epoxy, solder, or fasteners. In still other implementations, however, the storage device 430 is not secured to the insulating layer 720 during the mount step 812.

A shape step 814 forms the extensions 714 of the conductive members 710 into contact elements suitable for engaging or interacting with a media reading interface or other connection assembly contacts. For example, the shape step 814 can shape and position the extensions 714 using a die former. In some implementations, the shape step 814 forms the extensions 714 into a generally rigid shape (e.g., a triangle, a French Roll, or a loop). In other implementations, the shape step 814 leaves the distal ends 719 of the extensions 714 free to form a spring contact (see FIGS. 17-19).

Figure 17:
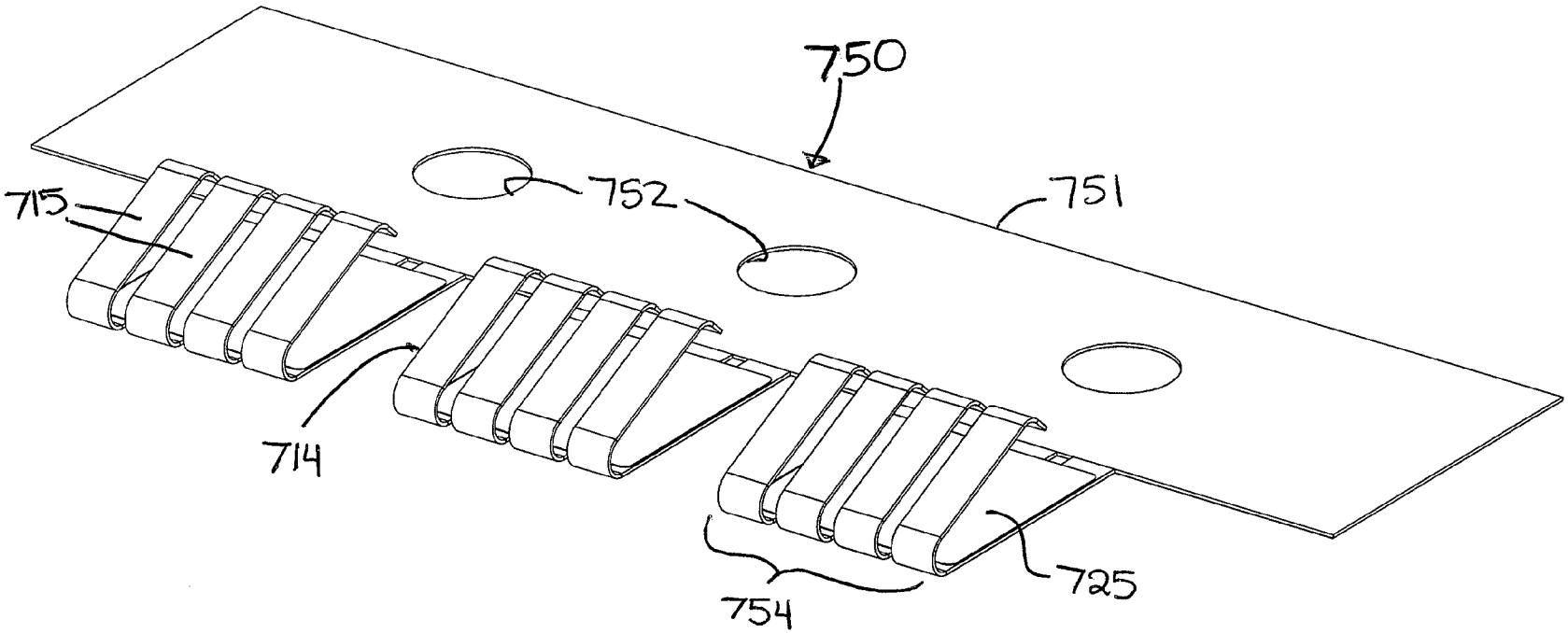
Figure 19:
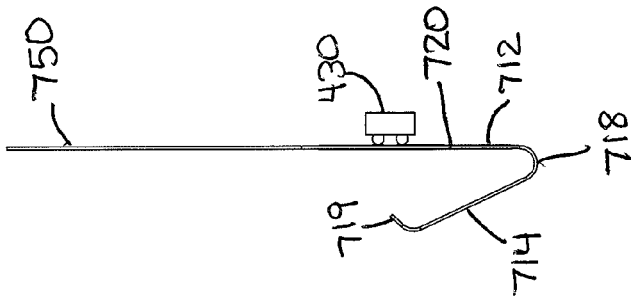
Figure 18:
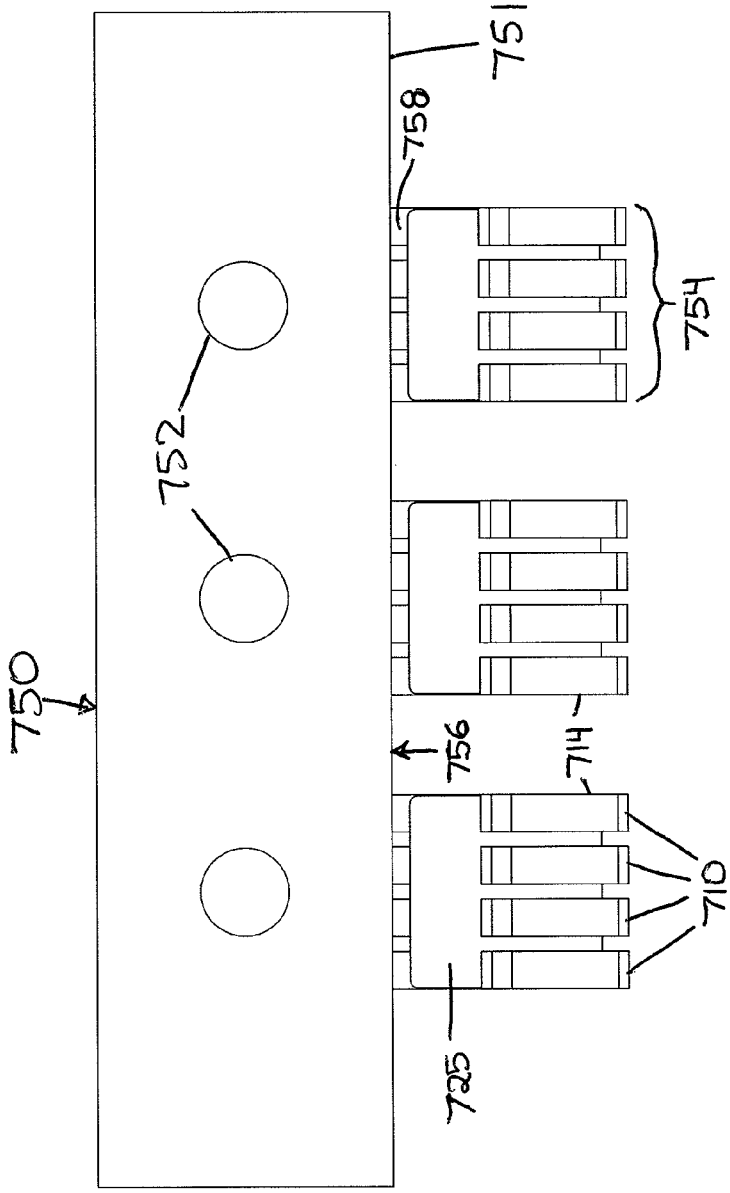

In some implementations, the shape step 814 forms each of the contact sections 714 of the conductive members 710 of each group 754 into the same shape. For example, the contact sections 714 of the conductive members 710 shown in FIG. 17 are each formed in a cantilevered spring configuration. In other implementations, however, the shape step 814 can form the contact sections 714 within each group 754 differently. For example, in some implementations, the shape step 814 can form some of the contact sections 714 into springs and others of the contact sections 714 into rigid configurations. In other implementations, the shape step 814 can form contact sections 714 having different heights or angles.

A detach step 816 separates the conductive members 710 from the carrier strip 750 to produce the contact arrangement 700. In some implementations, the detach step 816 separates the conductive members 710 from the carrier strip 750 by bending the conductive members 710 at the tab region 758 back and forth until breaking. In other implementations, the detach step 816 bends the conductive members 710 at a score line extending along the tabs 758. In still other implementations, the detach step 816 cuts (e.g., with a bladed edge) the conductive members 710 from the strip 750 at the tabs 758.

In one implementation, the steps of the manufacturing process 800 are performed in the order enumerated above. In other implementations, however, the steps can be performed in a different order. For example, the mount step 812 can be implemented after the detach step 816 to secure the storage device 730 to the insulating layer 720. The shape step 814 also can be optionally implemented after the detach step 816. The second build step 808 and plate step 810 also could be switched or even implemented after mounting the storage device 430 to the insulating layer 720. In one implementation, the plate step 810 can be performed after the shape step 814.

In some implementations, the contact arrangement 700 can be secured to a reinforcing layer before being mounted to the plug 402. For example, the contact arrangement 700 can be mounted to a board (e.g., FR4 printed circuit board), panel, or block to facilitate mounting the contact arrangement 700 to the plug 402.

Figure 20:
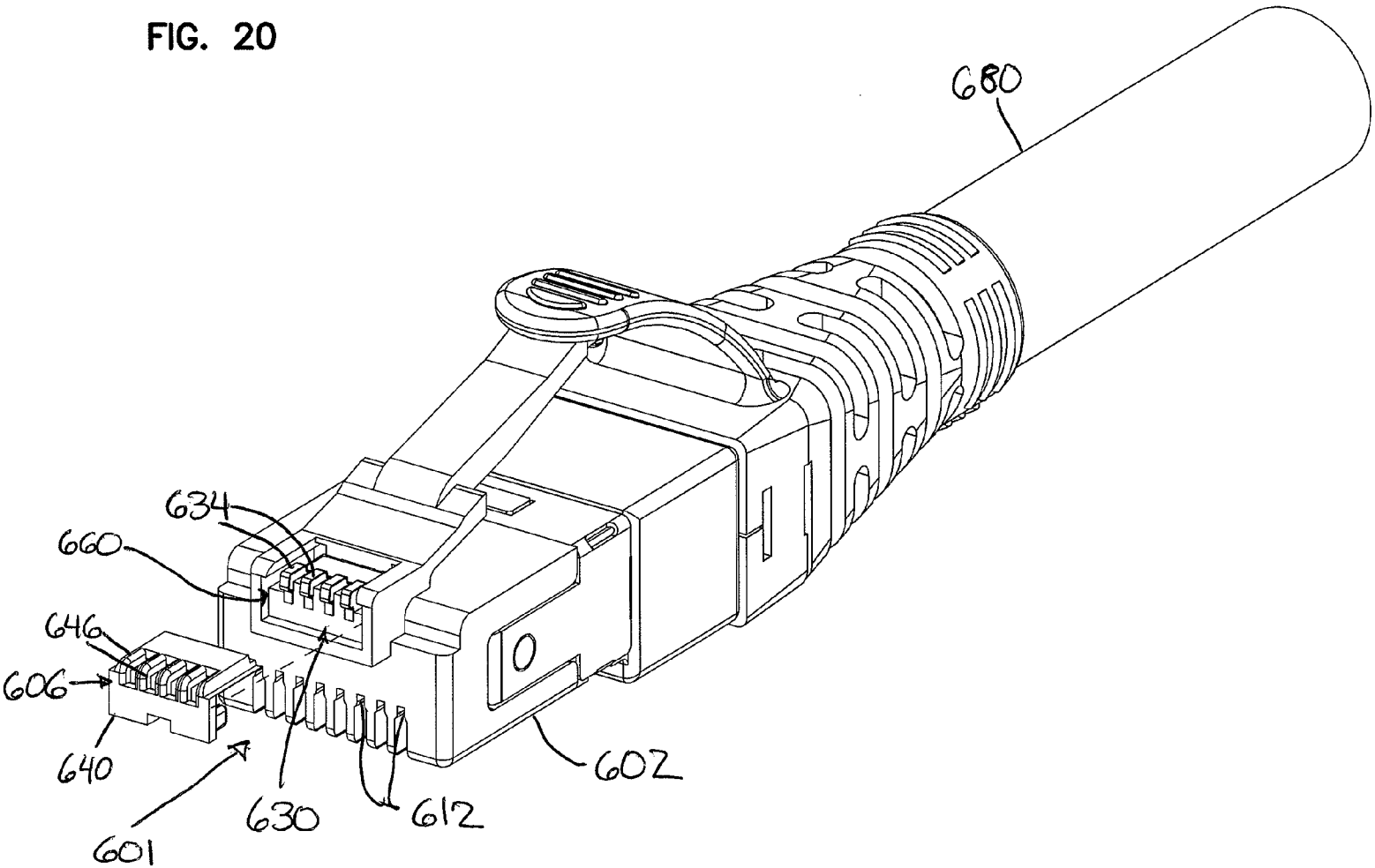
FIGS. 20-21 show a second example connector arrangement for terminating an electrical segment of telecommunications media in accordance with aspects of the present disclosure.
Figure 21:
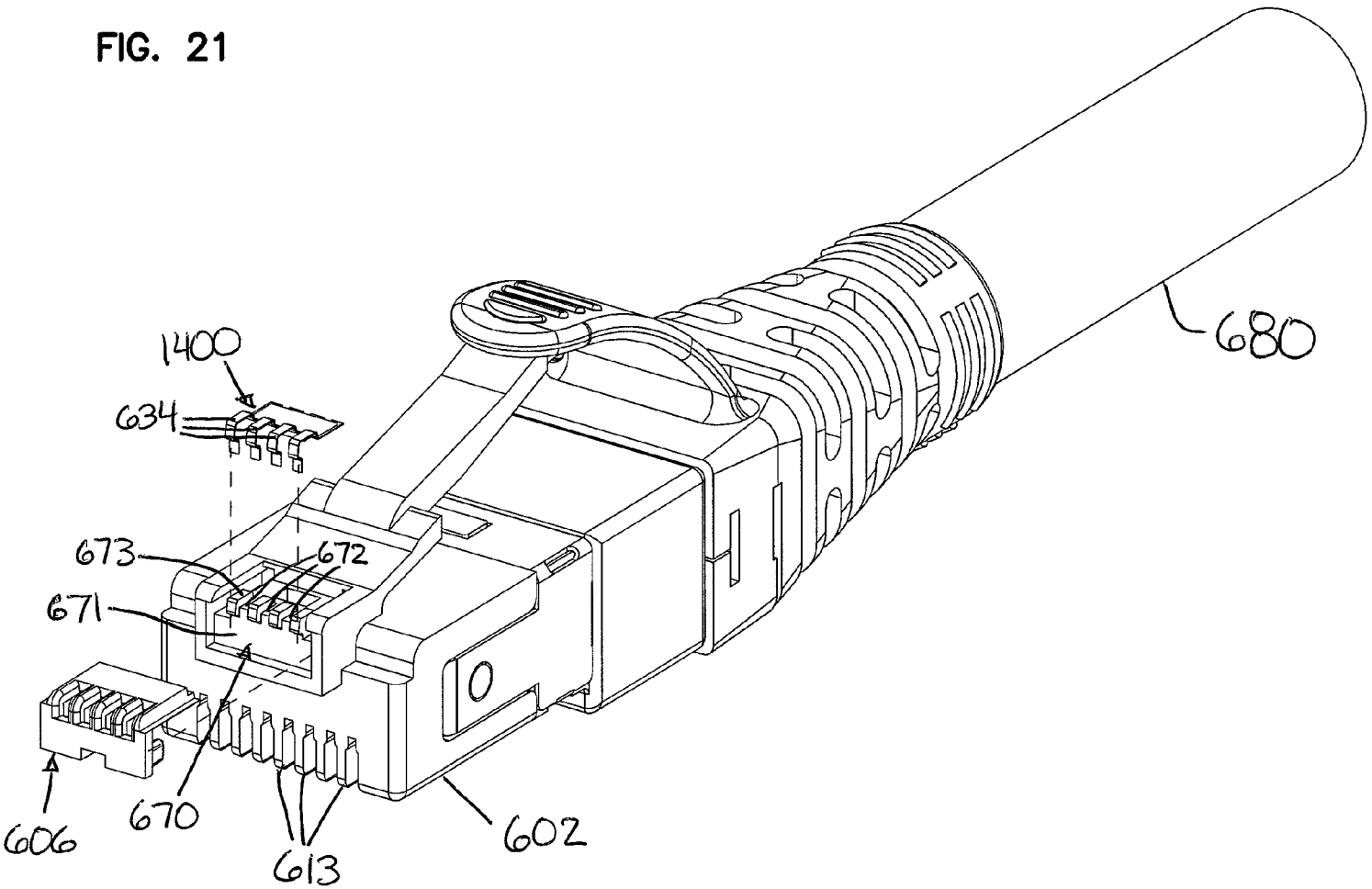
Figure 23:
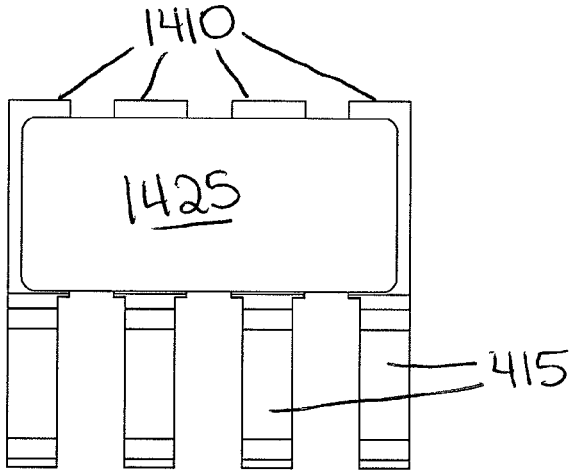
FIGS. 22-25 show a second example implementation of a contact arrangement having different configurations of contact members in accordance with aspects of the present disclosure.
Figure 25:
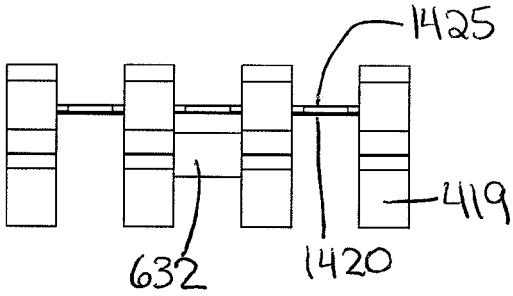
Figure 24:
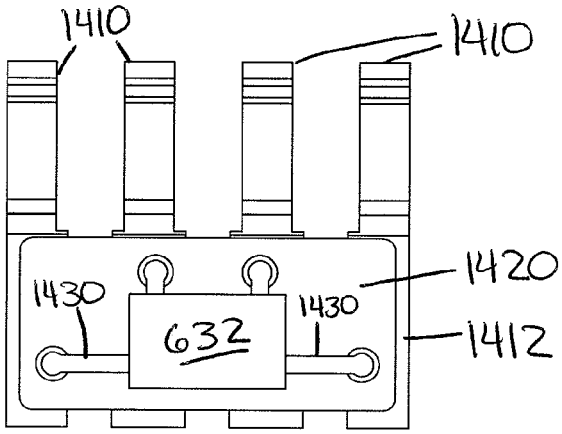
Figure 22:
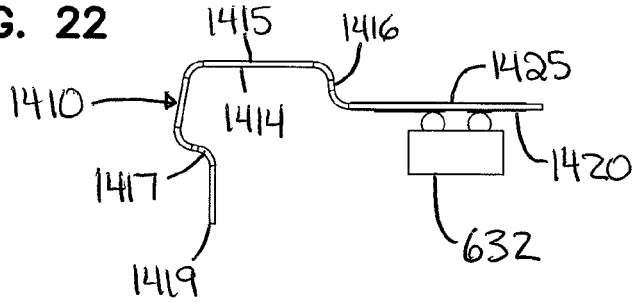

For example, FIGS. 20-21 show a second example connector arrangement 600 including a contact arrangement 1400 mounted to a reinforcing member. The connector arrangement 600 includes a modular plug 602 terminating an electrical cable 680. The modular plug 602 holds main signal contacts 612, which are electrically connected to the twisted pair conductors of the telecommunications cable 680. Ribs 613 protect the main signal contacts 612. The connector arrangement 600 is configured to be received, for signal transmission, within a port of a connector assembly, such as connector assembly 500 (FIG. 7). The main signal contacts 612 are configured to electrically connect to contacts 520 positioned in the jack module 510 for signal transmission.

The modular plug 602 also is configured to hold a storage device 630. The storage device 630 is configured to store information (e.g., an identifier and/or attribute information) pertaining to the segment of physical communications media (e.g., the plug 602 and/or the electrical cable 680 terminated thereby). In one implementation, the media storage device 630 includes an EEPROM 632. Circuit contacts 634 (FIG. 21) of the storage device 630 permit connection of the EEPROM 632 to a media reading interface, such as media reading interface 530 shown in FIG. 7. In other implementations, however, the storage device 630 can include any suitable type of memory.

In some implementations, the storage device 630 is mounted to or accommodated within the modular plug 602 (see FIG. 20). For example, the storage device 630 can be mounted to a contact arrangement 1400 (FIGS. 22-25), which can be seated on a reinforcing member 670 (FIG. 21). In some implementations, the reinforcing member 670 includes a body 671 configured to support the storage contacts 634 and accommodate the EEPROM 632 or other memory. In the example shown, the reinforcing member body 671 defines a cavity 672 that is sized to receive and accommodate the EEPROM 632. The body 671 also includes raised ribs 673 on which the contacts 634 seat (see FIG. 20). In some implementations, the ribs 634 protrude forwardly of the rest of the body 671.

The reinforcing member 670 and the contact arrangement 1400 may be positioned on or in the plug nose 602 of connector arrangement 600. In the example shown, the reinforcing layer 670 and contact arrangement 1400 are mounted within a cavity 660 defined in the plug nose 602 (see FIG. 20). For example, in certain implementations, the plug nose 602 defines a cavity 660 at a front 601 of the plug nose 602. The reinforcing member 670 can be slid along guide grooves or otherwise positioned (e.g., latched, glued) within the cavity 660.

In the example shown, a cover section 606 covers or closes the open cavity 660 (see FIGS. 20 and 21). The cover section 606 includes a body 640 defining ribs 646 that provide access to contacts 634 of the storage device 630 within the cavity 660. For example, in one implementation, contacts of a media reading interface 530 on a patch panel or jack module 510 (see FIG. 7) can extend through the ribs 646 to connect to the circuit contacts 634 on the storage device 630 when the plug 600 is inserted into a socket 500.

FIGS. 22-25 show a second example contact arrangement 1400 that includes a storage device 630 installed on an insulating layer 1420 with tracings 1430. The insulating layer 1420 covers mounting section 1412 of one or more conductive members 1410. In certain implementations, a second insulating surface 1425 also extends over a mounting section 1412 of the conductive members 1410. In the example shown, the conductive layer 1420 couples to four conductive members 1410. In other implementations, the conductive layer 1420 can connect a greater or lesser number of conductive members 1410.

The conductive members 1410 include contact sections 1414 that define contact surfaces 1415. In the example shown, the contact sections 1414 are shaped to accommodate the raised ribs 673 of the reinforcing layer 670. In some implementations, the contact sections 1414 of the conductive members 1410 are stepped (1416) upwardly from the second insulating layer 1425 to extend generally parallel to the insulating layers 1420, 1425. Each contact section 1414 bends downwardly over a front of the respective raised rib 673 and curves (1417) under the rib 673. A distal end 1419 of the contact section 1414 extends over a front side of the reinforcing member 670. In certain implementations, the contact sections 1414 are configured to function as springs.

Figure 27:
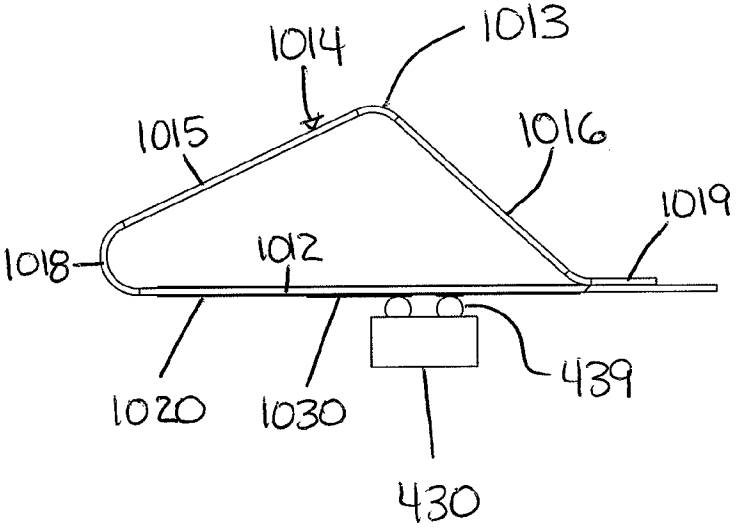
FIGS. 26-27 show a third example implementation of a contact arrangement having a different configuration of contact members in accordance with aspects of the present disclosure.
Figure 26:
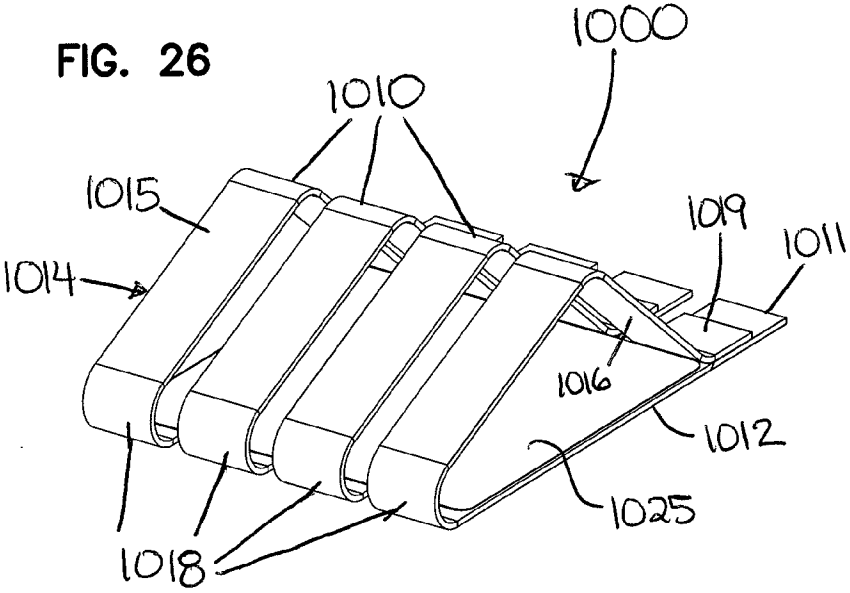

FIGS. 26-31 show other example implementations of contact arrangements having different configurations of contact members. For example, FIGS. 26 and 27 show a third example implementation of a contact arrangement 1000 that includes a storage device 430 installed on an insulating layer 1020 with tracings 1030. The insulating layer 1020 covers the mounting section 1012 of one or more conductive members 1010. In certain implementations, a second insulating surface 1025 also extends over a mounting section 112 of the conductive members 1010. In the example shown, the conductive layer 1020 couples to four conductive members 1010. In other implementations, the conductive layer 1120 can connect a greater or lesser number of conductive members 1010.

The conductive members 1010 include contact sections 1014 that define contact surfaces 1015. The contact sections 1014 extend upwardly from bent or curved sections 1018. However, the contact sections 1014 of conductive members 1010 are rigidly configured. For example, the contact sections 1014 and support sections 1016 of the conductive members 1010 define a triangle or arced shape. The support sections 1016 are angled downwardly toward the mounting sections 712 from the contact sections 1014 at a bent or curved section 1013.

In some implementations, the mounting section 1012, the contact section 1014, and a support section 1016 are shaped to encircle the second insulating surface 1025. For example, in some implementations, opposite ends 1011, 1019 of the conductive members 1010 engage each other. In certain implementations, the opposite ends 1011, 1019 are joined together (e.g., via soldering, welding, adhesive, etc.). In the example shown, the edge of the second end 1019 of each conductive member 1010 is spaced inwardly from the edge of the first end 1011 of each conductive member 1010.

Figure 29:
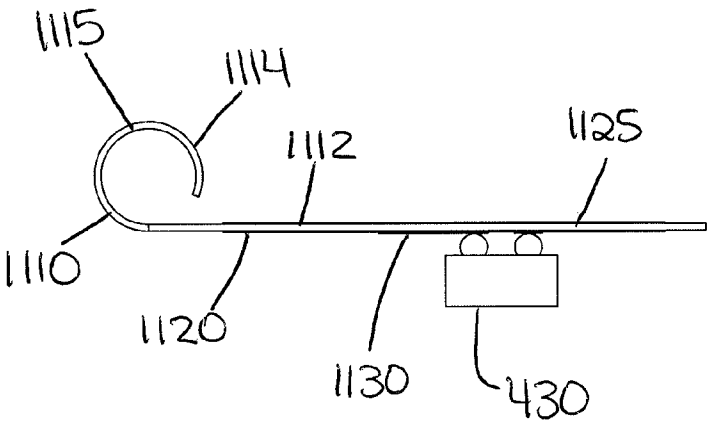
FIGS. 28-29 show a fourth example implementations of a contact arrangement having a different configuration of contact members in accordance with aspects of the present disclosure.
Figure 28:
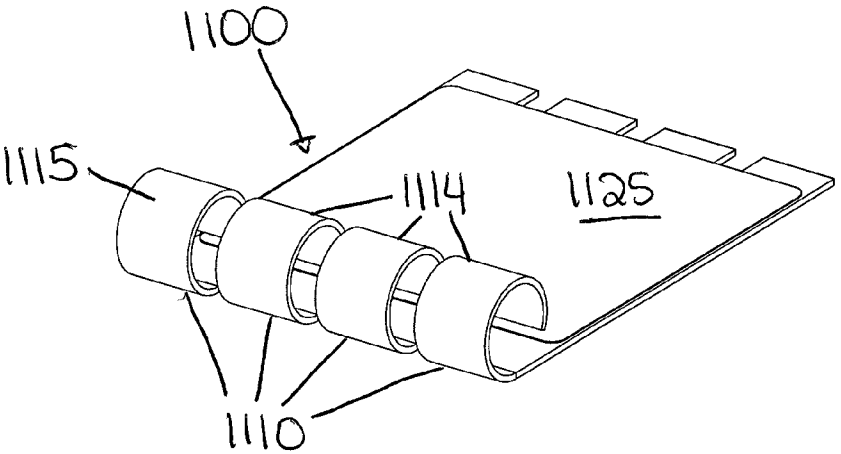

FIGS. 28 and 29 show a fourth example implementation of a contact arrangement 1100 that includes a storage device 430 installed on an insulating layer 1120 with tracings 1130. The insulating layer 1120 covers the mounting section 1112 of one or more conductive members 1110. In certain implementations, a second insulating surface 1125 also extends over a mounting section 1112 of the conductive members 1110. In the example shown, the conductive layer 1120 couples to four conductive members 1110. In other implementations, the conductive layer 1120 can connect a greater or lesser number of conductive members 1110.

The conductive members 1110 include contact sections 1114 that define contact surfaces 1115. In the example shown, the contact sections 1114 are shaped in a partial loop configuration. In some implementations, the contact sections 1114 of the conductive members 1110 are curved into an incomplete circle (see FIG. 17). In certain implementations, the contact sections 1114 may function as a spring in such a configuration. In other implementations, the contact sections 1114 can be fully rolled into a complete loop.

Figure 31:
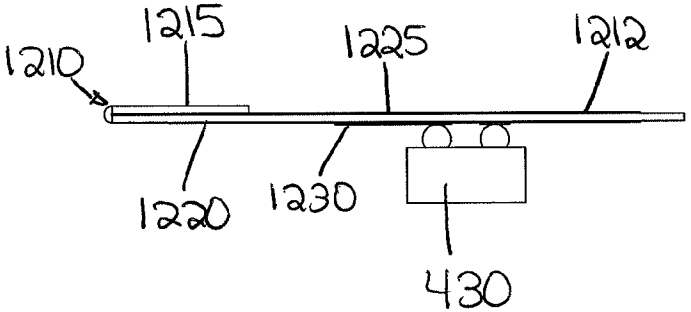
FIGS. 30-31 show a fifth example implementations of a contact arrangement having a different configuration of contact members in accordance with aspects of the present disclosure.
Figure 30:
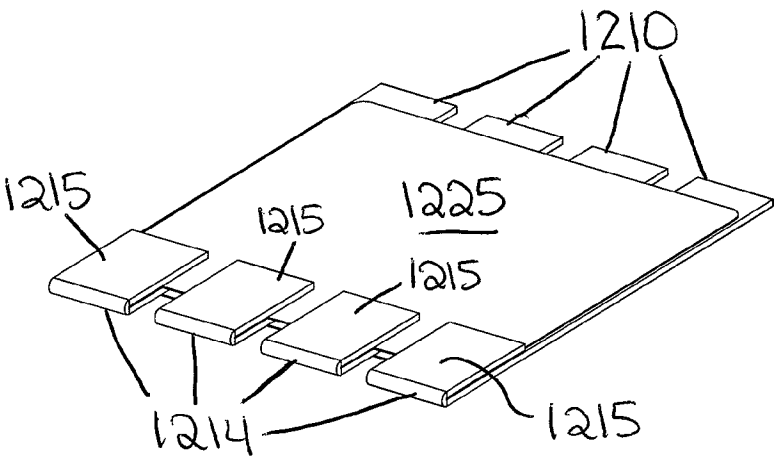

FIGS. 30 and 31 show a fifth example implementation of a contact arrangement 1200 that includes a storage device 430 installed on an insulating layer 1220 with tracings 1230. The insulating layer 1220 covers the mounting section 1212 of one or more conductive members 1210. In certain implementations, a second insulating surface 1225 also extends over a mounting section 1212 of the conductive members 1210. In the example shown, the conductive layer 1220 couples to four conductive members 1210. In other implementations, the conductive layer 1220 can connect a greater or lesser number of conductive members 1210.

The conductive members 1210 include contact sections 1214 that define a French Roll configuration. The contact sections 1214 of the conductive members 1210 are rolled, bent, or folded over so that a first surface of each contact section 1214 lays generally flat against a corresponding mounting section 1212 and/or second insulating surface 1225. Second surfaces of the contact sections 1214 define the contact surfaces 1215. For example, the contact surfaces 1215 may face the same direction as the second insulating surface 1225. In some implementations, the contact sections 1214 are sufficiently long to extend at least partially over the second insulating surface 1225. In other implementations, the contact sections 1214 terminate before reaching the second insulating surface 1225.

A number of implementations of the disclosure defined by the following claims have been described. Nevertheless, it will be understood that various modifications to the described embodiments may be made without departing from the spirit and scope of the claimed invention. Accordingly, other embodiments are within the scope of the following claims.

The invention claimed is:

1. A contact arrangement to be used with RJ plug, comprising:

a first insulating layer having a first side and a second side, the insulating layer defining at least one via extending from the first side of the first insulating layer to the second side of the first insulating layer;

a plurality of elongated conductive members, each elongated conductive member defining a mounting section and a contact section, the mounting section of each elongated conductive member having a first side and a second side, the first side of each mounting section being coupled to the first side of the first insulating layer to couple together the conductive members, the contact section of each conductive member extending in a non-planar direction relative to the mounting section;

a plurality of tracings extending over the second side of the first insulating layer, the tracings also extending through the via to electrically connect the first side of the first insulating layer to the second side of the first insulating layer;

a storage device mounted to the second side of the first insulating layer, the storage device being electrically connected to the elongated conductive members through the tracings; and contact surfaces defined on the contact sections of the elongated conductive members.

2. The contact arrangement of claim 1, further comprising a second insulating layer coupled to the second side of the mounting section of each elongated conductive member.

3. The contact arrangement of claim 1, wherein the contact sections of the elongated conductive members define springs.

4. The contact arrangement of claim 1, wherein the contact sections of the elongated conductive members define a rigid configuration.

5. The contact arrangement of claim 1, wherein the contact sections of the elongated conductive members define a French Roll configuration.

6. An RJ plug connector comprising:

a plug body including main contacts terminating conductors of an electrical cable, the plug body also defining a cavity configured to receive a reinforcing member;

a plurality of elongated conductive members seated on the reinforcing member, each of the elongated conductive members including a mounting section and a contact section, the contact section being non-planar with the mounting section, the contact sections of the conductive members forming secondary contacts for the plug body, the secondary contacts being electrically isolated from the electrical cable;

a first polymer layer formed over mounting surfaces of the conductive members;

a storage device mounted to the first polymer layer at a side opposite from the conductive members, the storage device being configured to fit within a cavity defined by the reinforcing member when the conductive members are seated on the reinforcing member; and a plurality of conductive tracing extending through the first polymer layer to connect the elongated conductive members to the storage device.

* * * * *